US008494385B2

(12) United States Patent
Terao et al.

(10) Patent No.: US 8,494,385 B2
(45) Date of Patent: Jul. 23, 2013

(54) IMAGE FORMING APPARATUS

(75) Inventors: Masakazu Terao, Kanagawa (JP); Kentarou Matsumoto, Tokyo (JP); Shinya Kobayashi, Kanagawa (JP); Akio Tsujita, Kanagawa (JP); Masato Lio, Kanagawa (JP); Katsuhiro Shinohara, Kanagawa (JP); Tadashi Kasai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 352 days.

(21) Appl. No.: 12/929,556

(22) Filed: Feb. 1, 2011

(65) Prior Publication Data

US 2011/0206429 A1 Aug. 25, 2011

(30) Foreign Application Priority Data

Feb. 25, 2010 (JP) ..... 2010-039972
Mar. 1, 2010 (JP) ..... 2010-044756
Oct. 7, 2010 (JP) ..... 2010-227807

(51) Int. Cl.
*G03G 15/08* (2006.01)
*G03G 15/20* (2006.01)

(52) U.S. Cl.
USPC ..... 399/53; 399/341

(58) Field of Classification Search
USPC ..... 399/39, 45, 53, 341
See application file for complete search history.

(56) References Cited

U.S. PATENT DOCUMENTS

| | | | | |
|---|---|---|---|---|
| 5,260,753 | A | 11/1993 | Haneda et al. | |
| 5,925,889 | A | 7/1999 | Guillory et al. | |
| 6,535,712 | B2 * | 3/2003 | Richards | 399/341 |
| 7,502,582 | B2 * | 3/2009 | Ng et al. | 399/296 |
| 7,522,852 | B2 * | 4/2009 | Toyohara | 399/45 |
| 7,965,961 | B2 * | 6/2011 | Priebe et al. | 399/231 |
| 8,351,809 | B2 * | 1/2013 | Takemura | 399/53 |

FOREIGN PATENT DOCUMENTS

| | | | |
|---|---|---|---|
| JP | 09-200551 | A | 7/1997 |
| JP | 11-216938 | A | 8/1999 |
| JP | 2003-091095 | A | 3/2003 |
| JP | 2006-251722 | A | 9/2006 |
| JP | 2007-163902 | A | 6/2007 |

OTHER PUBLICATIONS

JIS (Japanese Industrial Standard) "Specular glossiness—methods of Measurement" (JIS Z 8741-1997).

* cited by examiner

*Primary Examiner* — David Gray
*Assistant Examiner* — Gregory H Curran
(74) *Attorney, Agent, or Firm* — Harness, Dickey & Pierce, P.L.C.

(57) ABSTRACT

An image forming apparatus including a color toner image forming unit that forms a color toner image on a recording medium; a first colorless transparent toner image forming unit that forms a first colorless transparent toner image on the color toner image; a first fixing unit that fixes the image on the recording medium; a gloss level increasing device that increases a gloss level of the entire image on the recording medium that has been fixed; a second colorless transparent toner image forming unit that forms a second colorless transparent toner image on the image whose gloss level has been increased; and a second fixing unit that fixes the second colorless transparent toner image on the recording medium.

20 Claims, 18 Drawing Sheets

FIG.5

| GLOSS PRODUCTION METHOD | | PROBABILITY (%) | CLEAR TONER IMAGE FORMING DEVICE 202 | GLOSS LEVEL INCREASING DEVICE 204 | SECOND CLEAR TONER IMAGE FORMING DEVICE 205, SECOND FIXING DEVICE 206 | |
|---|---|---|---|---|---|---|
| | | | Clr | SW | SW2 | Clr2 |
| STEP 405 GLOSS PRODUCTION METHODS A AND D | A | Pa | INVERSE | CONTACT (HOWEVER, SEPARATED WHILE Pa=0) | CONTACT (HOWEVER, SEPARATED WHILE Pd=0) | 0 (%) |
| | D | Pd | 0 (%) | | | 100 (%) |
| STEP 404 GLOSS PRODUCTION METHODS B, C, AND D | B | Pb | INVERSE | SEPARATED | CONTACT (HOWEVER, SEPARATED WHILE Pd=0) | 0 (%) |
| | C | Pc | HALFTONE DOTS | | | 0 (%) |
| | D | Pd | 0 (%) | | | 100 (%) |
| STEP 403 GLOSS PRODUCTION METHODS B AND C | B | Pb | INVERSE | SEPARATED | SEPARATED | 0 (%) |
| | C | Pc | HALFTONE DOTS | | | 0 (%) |
| PIXEL HAVING GLOSS LEVEL INFORMATION Gs=0, IN ALL OF THE ABOVE STEPS | | | 0 (%) | IN ACCORDANCE WITH THE ABOVE | | 0 (%) |

FIG.11

| GLOSS PRODUCTION METHOD | | PROBABILITY (%) | CLEAR TONER IMAGE FORMING DEVICE 202 | GLOSS LEVEL INCREASING DEVICE 204 | SECOND CLEAR TONER IMAGE FORMING DEVICE 205, SECOND FIXING DEVICE 206 | |
|---|---|---|---|---|---|---|
| | | | Clr | SW | SW2 | Clr2 |
| STEP 405 GLOSS PRODUCTION METHODS A AND D | A | Pa | INVERSE | CONTACT | CONTACT | 0 (%) |
| | D | Pd | 0 (%) | | | 100 (%) |
| STEP 404 GLOSS PRODUCTION METHODS B, C, AND D | B | Pb | INVERSE | SEPARATED | CONTACT | 0 (%) |
| | C | Pc | HALFTONE DOTS | | | 0 (%) |
| | D | Pd | 0 (%) | | | 100 (%) |
| STEP 403 GLOSS PRODUCTION METHODS B AND C | B | Pb | INVERSE | SEPARATED | SEPARATED | 0 (%) |
| | C | Pc | HALFTONE DOTS | | | 0 (%) |
| PIXEL HAVING GLOSS LEVEL INFORMATION Gs=0, IN ALL OF THE ABOVE STEPS | | | Clr4 | IN ACCORDANCE WITH THE ABOVE | | 0 (%) |

FIG.12

| GLOSS PRODUCTION METHOD | | PROBABILITY (%) | CLEAR TONER IMAGE FORMING DEVICE 202 | GLOSS LEVEL INCREASING DEVICE 204 | SECOND CLEAR TONER IMAGE FORMING DEVICE 205, SECOND FIXING DEVICE 206 | |
|---|---|---|---|---|---|---|
| | | | Clr | SW | SW2 | Clr2 |
| STEP 405 GLOSS PRODUCTION METHODS A AND D | A | Pa | INVERSE | CONTACT | CONTACT | 0 (%) |
| | D | Pd | 0 (%) | | | 100 (%) |
| PIXEL HAVING GLOSS LEVEL INFORMATION Gs=0, IN STEP S405 | | | 0 (%) | | | Clr4 |
| STEP 404 GLOSS PRODUCTION METHODS B, C, AND D | B | Pb | INVERSE | SEPARATED | CONTACT | 0 (%) |
| | C | Pc | HALFTONE DOTS | | | 0 (%) |
| | D | Pd | 0 (%) | | | 100 (%) |
| STEP 403 GLOSS PRODUCTION METHODS B AND C | B | Pb | INVERSE | SEPARATED | SEPARATED | 0 (%) |
| | C | Pc | HALFTONE DOTS | | | 0 (%) |
| PIXEL HAVING GLOSS LEVEL INFORMATION Gs=0, IN STEPS S403 AND S404 | | | Clr4 | IN ACCORDANCE WITH STEPS S403 AND S404 | | 0 (%) |

IMAGE FORMING APPARATUS

BACKGROUND OF THE INVENTION

1. Field of the Invention

The present invention relates to an image forming apparatus such as a copier, a printer, and a fax machine that forms glossy images, and to an image forming apparatus that controls the gloss level in images recorded by an electrophotographic recording method and that forms three-dimensional images.

2. Description of the Related Art

Conventionally, there is an image forming apparatus that forms a color toner image by developing a latent image formed on a photoconductor, with the use of toner of plural colors. In the image formed by such an image forming apparatus, colors are reproduced by applying a powder type color material referred to as toner. When toner is applied, the gloss level changes. In the present application, the "gloss level" means the specular gloss (mirror gloss) as defined in patent document 1 and JIS (Japanese Industrial Standard) (JIS Z 8741) (see non-patent document 1). More specifically, in the present application, the "gloss level" refers to a "60 degree gloss level" as a typical example. Generally, the gloss level increases as the amount of applied toner increases. Meanwhile, the amount of toner adhering to an image varies depending on the location in the image for the purpose of reproducing various colors. Thus, in general, the gloss level is high in solid parts of the image, while the gloss level is low in halftone dot parts of the image. Consequently, the gloss level may be needlessly varied and the image quality may be degraded.

Patent documents 1 and 2 disclose an image forming apparatus that uses colorless and transparent clear toner in addition to four toner colors of Y (yellow), M (magenta), C (cyan), and K (black). In this image forming apparatus, the clear toner is applied such that the total amount of toner (including the four toner colors of Y, M, C, K and the clear toner) is even across the entire image. Accordingly, the gloss level can be made even across the entire image, regardless of the various colors reproduced by the color toner.

However, in the image forming apparatus disclosed in patent documents 1 and 2, although the gloss level on the surface of the image can be made even by applying clear toner, the extent of the expressed gloss is limited. Therefore, it has not been possible to express high glossiness such as that of a silver salt photograph.

Patent document 3 discloses an image forming apparatus and a fixing device having the following features. Specifically, an image formed on a recording medium with color toner is sandwiched by a belt whose surface is mirror-polished, so that the image is heated and melted. Subsequently, the image formed on the recording medium with color toner is cooled while being sandwiched by the belt. When the temperature of the toner becomes low, the belt is peeled off from the toner image. Accordingly, the mirror-like characteristic of the belt is transferred to the toner, so that a highly glossy image having photographic gloss is formed. The principle of the fixing process including heating and cooling a toner image sandwiched by a belt and then peeling off the belt is referred to as a "cooling and peeling principle".

However, with such an image forming apparatus that increases the gloss level of images with the use of the cooling and peeling principle as disclosed in patent document 3, the following two problems have not been solved.

The first problem is relevant to the reproduction range of the gloss level. In the image forming apparatus according to patent document 3, the solid parts can have a high gloss level with the use of clear toner, regardless of the level of color reproduction. Furthermore, by using the fixing device employing the cooling and peeling principle, images of an even higher gloss level having photographic gloss can be formed. However, there is a lower limit to the gloss level, and therefore images of a low gloss level cannot be produced.

Images with highly glossy surfaces are high-quality, and are therefore typically used as expensive photographs. However, if images that primarily include characters and figures have a high gloss level, it may be difficult to read the characters/figures when irradiated by surrounding illumination. Therefore, images primarily including characters and figures preferably have a low gloss level. For this reason, there is also large demand for producing images with a low gloss level.

The second problem is relevant to the adjustment of the gloss level according to respective positions in a glossy image. When the image forming apparatus disclosed in patent document 3 is used to produce an image having the gloss level of a photograph, the entire image will have the gloss level of a photograph. It is not possible to produce low gloss level portions and high gloss level portions in the same image. There are cases where photographic images and character/figure images are included in the same image. In this case, the gloss level is preferably separately set for the respective portions. Furthermore, when an image includes a photographed image of a metal object, the metal texture can be expressed by increasing the gloss level at the metal part. In this case also, there is demand for a technology for changing the gloss level of part of an image.

Patent document 4 discloses an image forming apparatus in which an image is formed with the use of heat foaming toner instead of transparent toner, for producing printed matter with high added value such as Braille printing.

There is demand for high value added printing, such as increasing the height of particular images so that a user can feel the images by touching them, or Braille printing that requires the characters to have a height of 300 μm or more.

When images having a photographic gloss level are formed by conventional apparatuses, the entire image appears to have photographic gloss. Therefore, it is not possible to print an image including portions having a low gloss level and portions having a high gloss level without reducing the printing productivity.

In the conventional technology, when creating an image including photographs and low gloss level portions, or when creating an image including photographs and three dimensional images such as Braille characters, first, the gloss level of the entire image needs to be increased to a photographic gloss level. Subsequently, the image needs to be passed through a conventional image forming apparatus or an image forming apparatus with which three-dimensional printing can be performed. Accordingly, the printing productivity is significantly reduced.

Patent Document 1: Japanese Patent No. 3146367

Patent Document 2: Japanese Laid-Open Patent Application No. H9-200551

Patent Document 3: Japanese Laid-Open Patent Application No. 2007-163902

Patent Document 4: Japanese Laid-Open Patent Application No. 2003-091095

Non-patent document 1: JIS (Japanese Industrial Standard) "Specular glossiness—methods of Measurement" (JIS Z 8741-1997)

SUMMARY OF THE INVENTION

The present invention provides an image forming apparatus, in which one or more of the above-described disadvantages are eliminated.

A preferred embodiment of the present invention provides an image forming apparatus with which a wide range of gloss levels ranging from a low gloss level to a high gloss level can be reproduced, an optional gloss level can be reproduced in an optional area in an image, and the height of an optional part of the image can be increased so that the part can be felt when touched, without reducing the printing productivity.

According to an aspect of the present invention, there is provided an image forming apparatus including a color toner image forming unit that forms a color toner image on a recording medium, with the use of at least one of plural color toners of different colors; a first colorless transparent toner image forming unit that forms a first colorless transparent toner image on the color toner image, with the use of a first colorless transparent toner; a first fixing unit that fixes the color toner image and the first colorless transparent toner image on the recording medium, so that an image formed by using the at least one of plural color toners and the first colorless transparent toner is fixed on the recording medium; a gloss level increasing device that increases a gloss level of the entirety of the image formed by using the at least one of plural color toners and the first colorless transparent toner on the recording medium that has been fixed by the first fixing unit; a second colorless transparent toner image forming unit that forms a second colorless transparent toner image on the image whose gloss level has been increased by the gloss level increasing device, with the use of a second colorless transparent toner; and a second fixing unit that fixes the second colorless transparent toner image on the recording medium.

According to one embodiment of the present invention, an image forming apparatus is provided, with which a wide range of gloss levels ranging from a low gloss level to a high gloss level can be reproduced, an optional gloss level can be reproduced in an optional area in an image, and the height of an optional part of the image can be increased so that the part can be felt when touched, without reducing the printing productivity.

BRIEF DESCRIPTION OF THE DRAWINGS

Other objects, features and advantages of the present invention will become more apparent from the following detailed description when read in conjunction with the accompanying drawings, in which:

FIG. 5 indicates specific process contents of the gloss production methods used in steps S403 through S405 of FIG. 4;

FIG. 11 indicates specific process contents of the gloss production methods used in steps S403 through S405 of FIG. 4, performed by a gloss production method determination processing unit shown in FIG. 10;

FIG. 12 indicates specific process contents of the gloss production methods used in steps S403 through S405 of FIG. 4, performed by a color image forming apparatus according to yet another embodiment of the present invention;

DETAILED DESCRIPTION OF THE PREFERRED EMBODIMENTS

A description is given, with reference to the accompanying drawings, of embodiments of the present invention.

Figure 1:
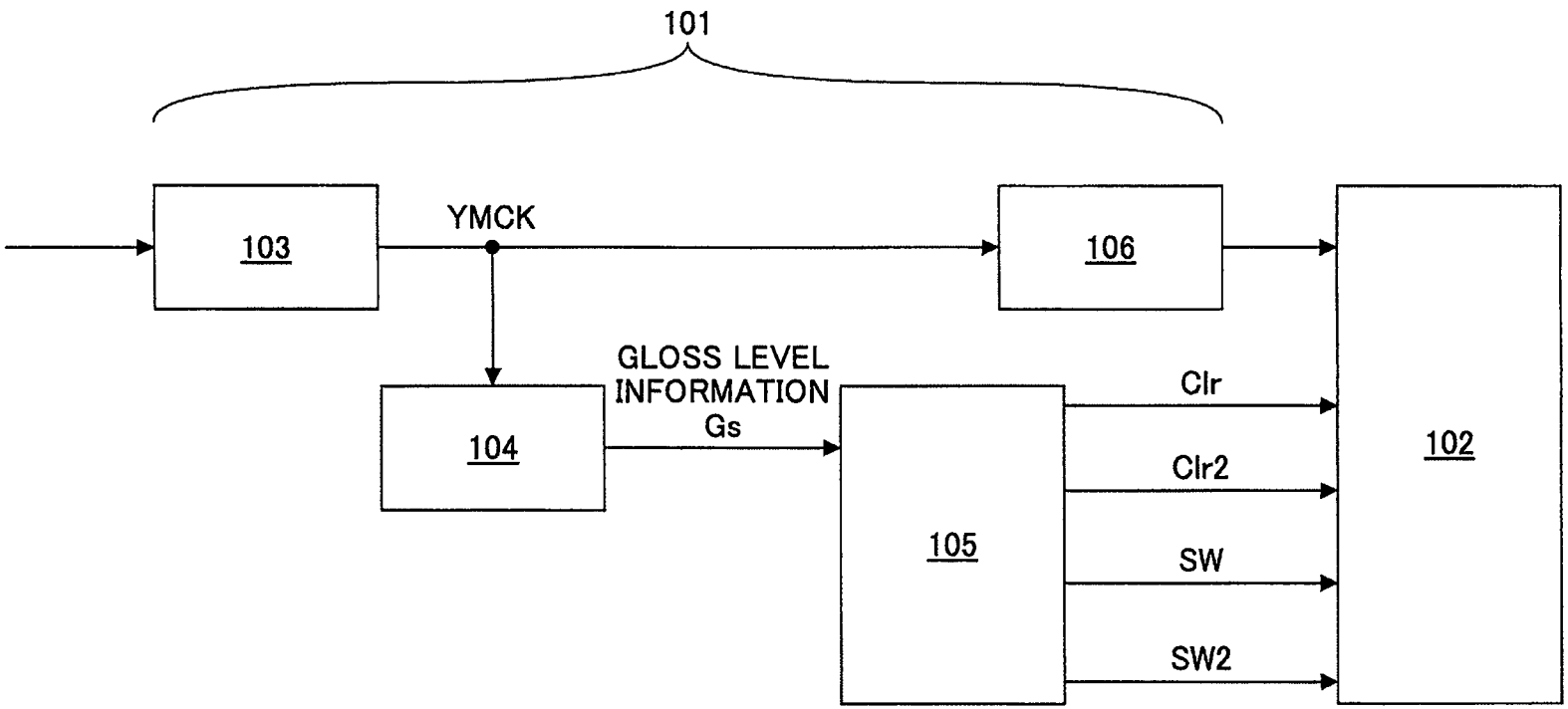
FIG. 1 is a block diagram of a color image forming apparatus according to an embodiment of the present invention.

FIG. 1 is a block diagram of a color image forming apparatus according to an embodiment of the present invention. The color image forming apparatus according to the present embodiment includes a printer controller 101 functioning as a control means and a printer engine 102 functioning as a toner image forming means. The printer controller 101 includes a RIP (Raster Image Processing) unit 103 functioning as an image data processing means, a gloss level information attachment proceeding unit 104 (gloss level information attachment means), and a gloss production method determination processing unit 105 (gloss production method determination means). The printer engine 102 forms color images with four toner colors of Y (yellow), M (magenta), C (cyan), and K (black) on a recording medium such as a transfer sheet, based on binary image data received from the printer controller 101. In the following description, the four colors of yellow, magenta, cyan, and black are respectively expressed by symbols Y, M, C, and K, according to need. A colorless and transparent toner is expressed by a symbol Clr, according to need.

The RIP unit 103 converts document data (image information) described in PDL (Page Description Language) created by a user, into color image signals including gradation image information of four toner colors YMCK (YMCK gradation image data), so that the printer engine 102 can form a four toner color image including pixels of the four toner colors of YMCK based on the YMCK gradation image data. In this case, the pixel size depends on the recording resolution of the printer engine 102. In the present embodiment, it is assumed that the pixel density is 600 pixels/inch and the pixel size is 1/600 inch, i.e., the image is square in shape and 42.3 μm in height and width. The gradation image information of four toner colors YMCK is digital information including information of 8 bits/pixel for each of the colors YMCK, i.e., a total of 32 bits/pixel. The gradation image information of four toner colors YMCK is converted into halftone dots, parallel lines, or FM screens by a screening processing unit 106 that is a typically known screening means. The converted data is output to the printer engine 102.

The gloss level information attachment proceeding unit 104 generates gloss level information Gs for each pixel based on the gradation image information of four toner colors YMCK (input pixel information) output from the RIP unit 103. The gloss level information Gs is then added to the gradation image information of four toner colors YMCK. In the present embodiment, the gloss level information Gs is digital information including 8 bits/pixel, similar to the gradation image information of four toner colors YMCK. Accordingly, the values that can be stored are integers from 0 through 255. In the present embodiment, the gloss level is basically the 60 degree gloss level defined by JIS as described in non-patent document 1. The gloss level information Gs is an integer of 0 through 100. The range of values of the gloss level information Gs is determined according to the printer engine 102, as described below. The gloss level information Gs is primarily determined by the designer while viewing the original image in YMCK. However, the gloss level information Gs may be described as a special color by the PDL (Page Description Language). Typically, the gloss level of the photographic image portion may be increased, the gloss level of the character/figure portion may be reduced, and the gloss level of images of metal parts or wet parts may be increased.

The gloss production method determination processing unit 105 determines the gloss production method for each pixel based on the gloss level information Gs, as described below. According to the determined gloss production method, the gloss production method determination processing unit 105 outputs, to the printer engine 102, first clear toner image information (hereinafter, simply referred to as "clear toner image information") Clr, second clear toner image information Clr2, first contact/separation information (hereinafter, simply referred to as "contact/separation information") SW, and second contact/separation-information SW2. Details are described below.

Figure 2:
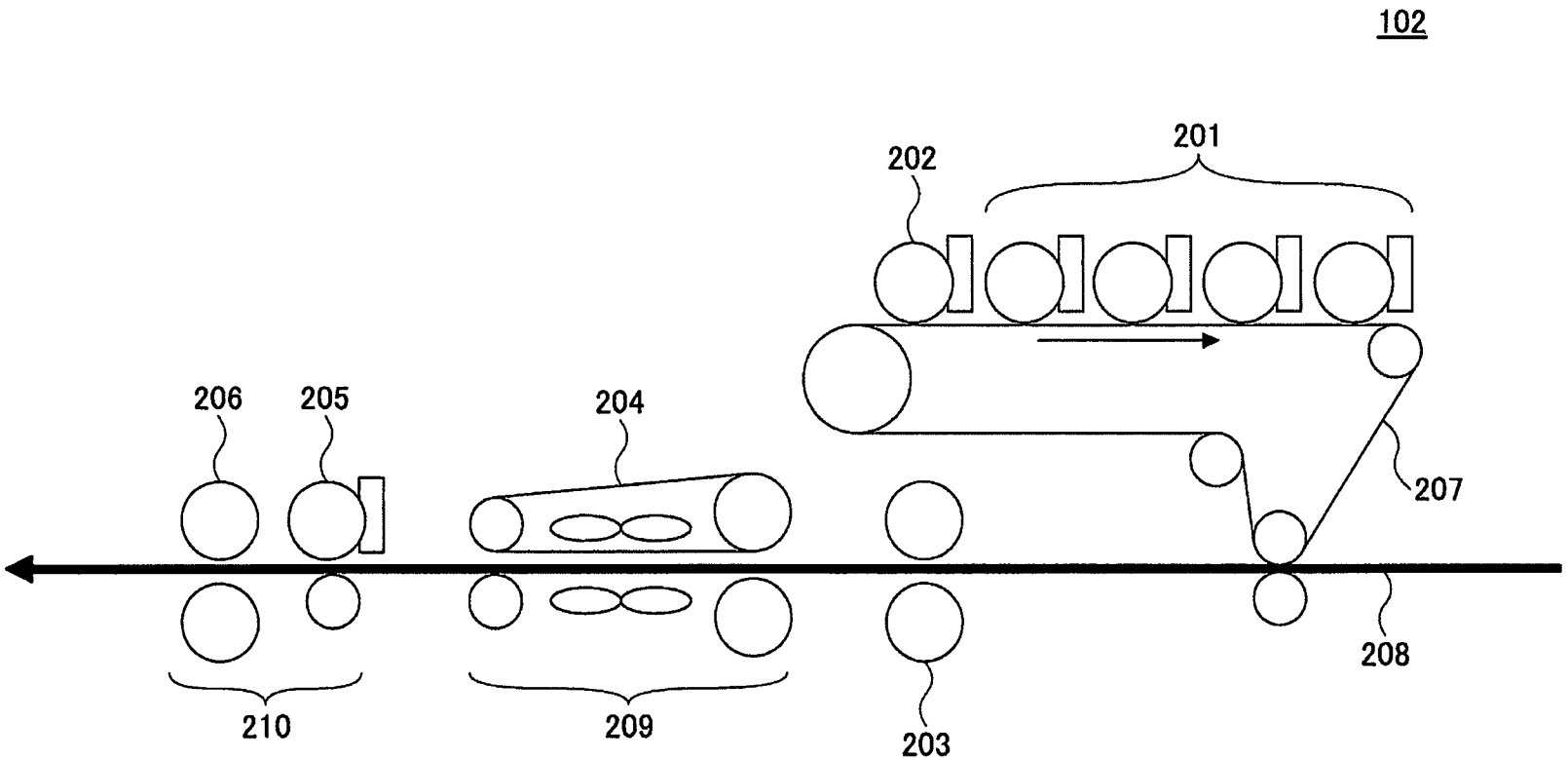
FIG. 2 is a schematic diagram of a printer engine included in the color image forming apparatus.

FIG. 2 is a schematic diagram of the printer engine 102. The gradation image information of four toner colors YMCK (color toner image information YMCK) is input to a color toner image forming device 201 (color toner image forming means). The color toner image forming device 201 may be, for example, a known color toner image forming device of an electrophotographic method. The printer engine 102 forms a YMCK toner image on an intermediate transfer belt 207 based on the color toner image information YMCK.

In the printer engine 102 according to the present embodiment, there is provided a clear toner image forming device 202 (first colorless transparent toner image forming means) on the upstream side of the color toner image forming device 201 (left side as viewed in FIG. 2). The clear toner image forming device 202 forms, on the intermediate transfer belt 207, a first clear toner image as a first colorless transparent toner image (hereinafter, simply referred to as a "clear toner image"), based on the clear toner image information Clr. Therefore, on the sheet acting as a recording medium on a sheet path 208 extending toward the left side as viewed in FIG. 2, a color toner image is formed on the sheet surface, and then a clear toner image is formed on top of the color toner image. The clear toner image and the color toner image are fixed on the sheet with a fixing device 203 (fixing means), so that the process of recording the image is completed.

The color toner image forming device 201, the clear toner image forming device 202, and the fixing device 203 are the same as those of the image forming apparatus disclosed in patent document 2. Therefore, only relevant parts (developing unit, photoconductive drum, and fixing unit) are schematically illustrated in FIG. 2. However, in the apparatus of patent document 2, the toner image on the photoconductive drum is directly transferred onto the sheet. In the color image forming apparatus according to the present embodiment, toner images of the respective colors are temporarily transferred onto the intermediate transfer belt 207, and are then transferred onto a sheet at once. Thus, the respective color toner images are transferred onto the sheet in the opposite order to the order of colors on the intermediate transfer belt 207. For this reason, in the present embodiment, the clear toner image forming device 202 is positioned at the most upstream position along the intermediate transfer belt 207.

The color image forming apparatus according to the present embodiment further includes a gloss level increasing device 204 (glossing means) using the cooling and peeling principle, which is provided immediately after the fixing device 203. The gloss level is increased across the entire image by the gloss level increasing device 204. The gloss level increasing device 204 is the same as the conventional device disclosed in patent document 3, and therefore only a part of the gloss level increasing device 204 is illustrated in FIG. 2. In the present embodiment, a known contact-separation mechanism 209 (not shown) is incorporated in the gloss level increasing device 204. Therefore, the rollers sandwiching the sheet are separated according to the contact/separation information SW, so that the sheet can pass through without being processed by the gloss level increasing device 204. The contact-separation mechanism 209 functions as a means for causing the rollers sandwiching the sheet to contact each other or separate from each other, so that the gloss level increasing device 204 may or may not perform the process of increasing the gloss level.

Furthermore, the color image forming apparatus according to the present embodiment includes a second clear toner image forming device 205 (second colorless transparent toner image forming unit) provided immediately after the gloss level increasing device 204. The second clear toner image forming device 205 transfers a second clear toner image (second colorless transparent toner image) onto a sheet on the sheet path 208, based on second clear toner image information Clr2. Finally, a second fixing device 206 (second fixing means) fixes the second clear toner image on the sheet, and all processes end.

The second clear toner image forming device 205 and the second fixing device 206 are substantially the same as those in the image forming apparatus disclosed in patent document 2, and therefore only relevant parts are schematically illustrated in FIG. 2. However, in the present embodiment, the second clear toner image forming device 205 and the second fixing device 206 only use a single color (clear toner), and therefore the intermediate transfer belt 207 is not required. In patent document 2, the image is directly transferred from the photoconductive drum to the sheet. Furthermore, in the present embodiment, a known second contact-separation mechanism 210 is incorporated in the second clear toner image forming device 205 and the second fixing device 206. Therefore, the rollers sandwiching the sheet may be separated according to the second contact/separation information SW2, so that the sheet can pass through without being processed by the second clear toner image forming device 205 or the second fixing device 206. The second contact-separation mechanism 210 functions as a means for causing the rollers sandwiching the sheet to contact each other or separate from each other, so that the second clear toner image forming device 205 may or may not form a second clear toner image and the second fixing device 206 may or may not perform the fixing process.

Next, a description is given of the gloss production method determination processing unit 105 with reference to FIGS. 3 through 9.

Figure 3:
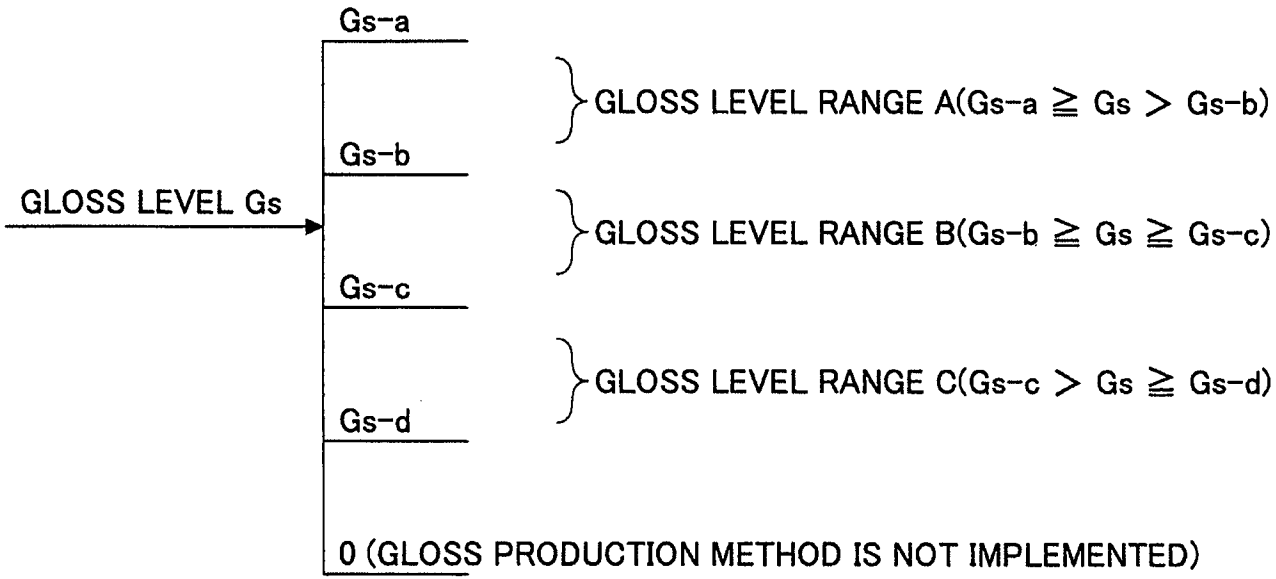
FIG. 3 illustrates the contents of gloss level information Gs that is input to a gloss production method determination processing unit of the color image forming apparatus.

FIG. 3 illustrates the contents of the gloss level information Gs that is input to the gloss production method determination processing unit 105. As described above, the gloss level information Gs that is added for each pixel is basically a 60 degree gloss level defined by JIS as described in non-patent document 1. The gloss level information Gs is an integer of 0 through 100. Meanwhile, in the present embodiment, there are four gloss production methods A, B, C, and D. As shown in FIG. 3, the maximum gloss level produced by the gloss production method A is defined as Gs-a, the maximum gloss level produced by the gloss production method B is defined as Gs-b, the maximum gloss level produced by the gloss production method C is defined as Gs-c, and the maximum gloss level produced by the gloss production method D is defined as Gs-d. Therefore, the gloss level range of the color image forming apparatus according to the present embodiment is Gs-d through Gs-a. The setting range of the gloss level information Gs is also Gs-d through Gs-a. As a matter of convenience, when the gloss level information Gs is set at zero, none of the gloss production methods are used, and a regular four color image in YMCK is output. Furthermore, the range from Gs-b to Gs-a ($Gs\text{-}b<Gs\leqq Gs\text{-}a$) is a gloss level range A, the range from Gs-c to Gs-b ($Gs\text{-}c\leqq Gs\leqq Gs\text{-}b$) is a gloss level range B, and the range from Gs-d to Gs-c ($Gs\text{-}d<Gs\leqq Gs\text{-}c$) is a gloss level range C.

Figure 4:
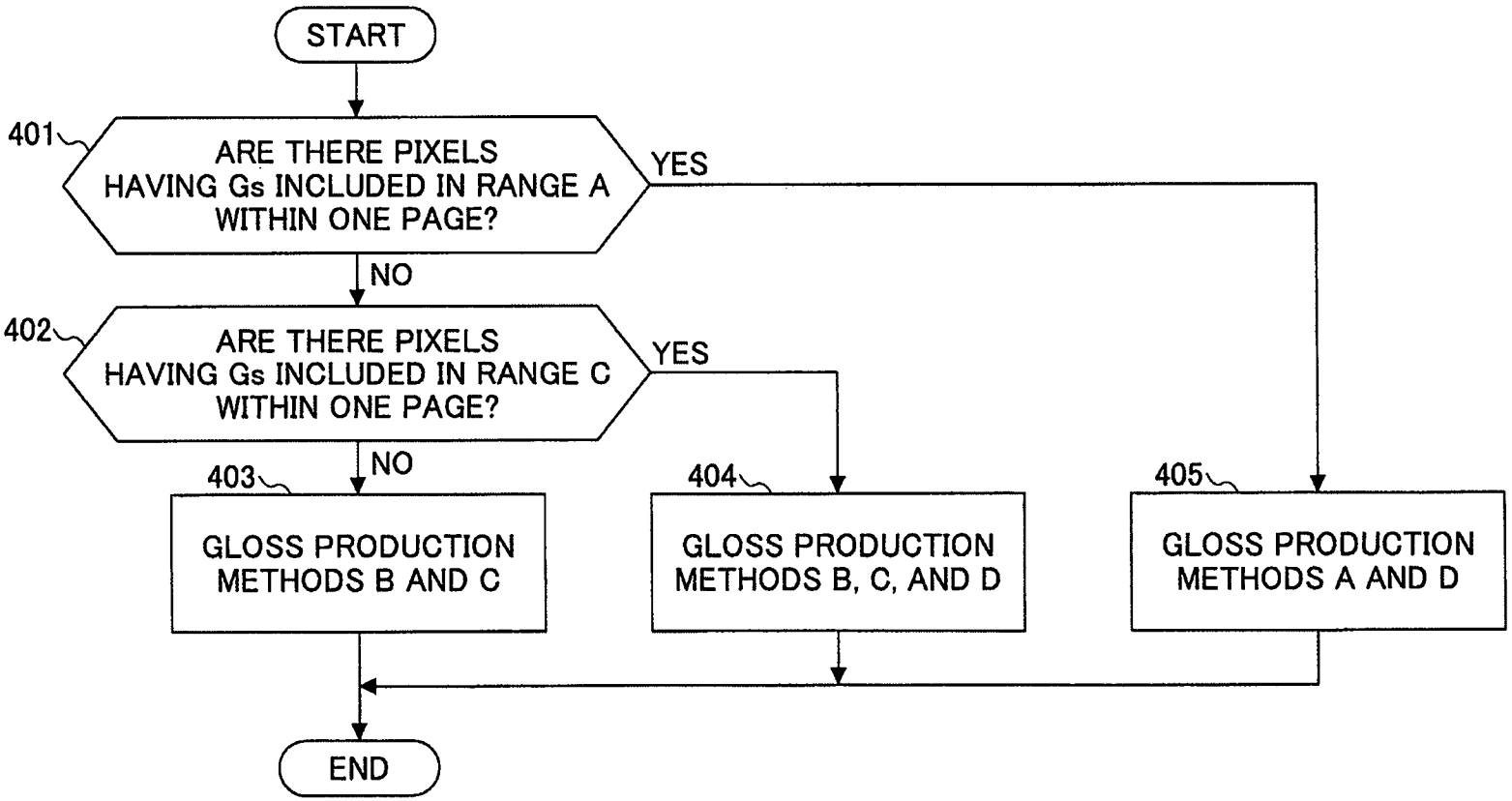
FIG. 4 is a flowchart of a process of determining the gloss production method performed by the gloss production method determination processing unit.

FIG. 4 is a flowchart of a process of determining the gloss production method performed by the gloss production method determination processing unit 105. First, the gloss production method determination processing unit 105 determines whether there are pixels having gloss level information Gs included in the gloss level range A, within an image corresponding to one page to be recorded on a sheet (step S401). When the gloss production method determination processing unit 105 determines that there are no pixels having gloss level information Gs included in the gloss level range A (No in step S401), the gloss production method determination processing unit 105 determines whether there are pixels having gloss level information Gs included in the gloss level range C, within an image corresponding to one page (step S402). When the gloss production method determination processing unit 105 determines that there are pixels having gloss level information Gs included in the gloss level range C (Yes in step S402), the gloss production method determination processing unit 105 determines to use the gloss production methods B, C, and D (step S404). When the gloss production method determination processing unit 105 determines that there are no pixels having gloss level information Gs included in the gloss level range C (No in step S402), the gloss production method determination processing unit 105 determines to use the gloss production methods B and C (step S403).

When the gloss production method determination processing unit 105 determines that there are pixels having gloss level information Gs included in the gloss level range A (Yes in step S401), the gloss production method determination processing unit 105 determines to use the gloss production methods A and D (step S405).

FIG. 5 indicates specific process contents of the gloss production methods used in steps S403 through S405 of FIG. 4. The process contents include determining the probability (%) of using each gloss production method for a pixel, the clear toner image information Clr, the second clear toner image information Clr2, the contact/separation information SW, and the second contact/separation information SW2. The information is output to the printer engine 102.

In step S405 of FIG. 4, first, the probability Pa (%) of using the gloss production method A for the pixel and the probability Pd (%) of using the gloss production method D for the pixel are determined based on the gloss level information Gs and the graph and table described below. Next, with respect to the gloss production method A, inverse information is set for the clear toner image information Clr and 0% is set for the second clear toner image information Clr2 (a second clear toner image is not formed). Furthermore, with respect to the gloss production method D, 0% is set for the clear toner image information Clr (a clear toner image is not formed) and 100% is set for the second clear toner image information Clr2 (a solid second clear toner image is formed). "Contact" is set for both the contact/separation information SW and the second contact/separation information SW2. However when the probability Pd=0%, "separate" is set for the second contact/separation information SW2, and when the probability Pa=0%, "separate" is set for the second contact/separation information SW.

In step S404 of FIG. 4, first, the probability Pb (%) of using the gloss production method B for the pixel, the probability Pc (%) of using the gloss production method C for the pixel, and the probability Pd (%) of using the gloss production method D for the pixel are determined based on the gloss level information Gs and the graph and table described below. Next, with respect to the gloss production method B, inverse information is set for the clear toner image information Clr and 0% is set for the second clear toner image information Clr2 (a second clear toner image is not formed). Furthermore, with respect to the gloss production method C, halftone dots (described below) are set for the clear toner image information Clr and 0% is set for the second clear toner image information Clr2 (a second solid second clear toner image is not formed). Furthermore, with respect to the gloss production method D, 0% is set for the clear toner image information Clr (a clear toner image is not formed) and 100% is set for the second clear toner image information Clr2 (a solid second clear toner image is formed). "Separate" is set for the contact/separation information SW and "contact" is set for the second contact/separation information SW2. However when the probability Pd=0%, "separate" is set for the second contact/separation information SW2.

In step S403 of FIG. 4, first, the probability Pb (%) of using the gloss production method B for the pixel and the probability Pc (%) of using the gloss production method C for the pixel are determined based on the gloss level information Gs and the graph and table described below. Next, with respect to the gloss production method B, inverse information is set for the clear toner image information Clr and 0% is set for the second clear toner image information Clr2 (a second clear toner image is not formed). Furthermore, with respect to the gloss production method C, halftone dots are set for the clear toner image information Clr and 0% is set for the second clear toner image information Clr2 (a second solid second clear toner image is not formed). "Separate" is set for both the contact/separation information SW and the second contact/separation information SW2.

In all of the cases in FIG. 5, for a pixel having gloss level information Gs=0, clear toner is not adhered to the image, and therefore 0% is set for both the clear toner image information Clr and the second clear toner image information Clr2.

Figure 6:
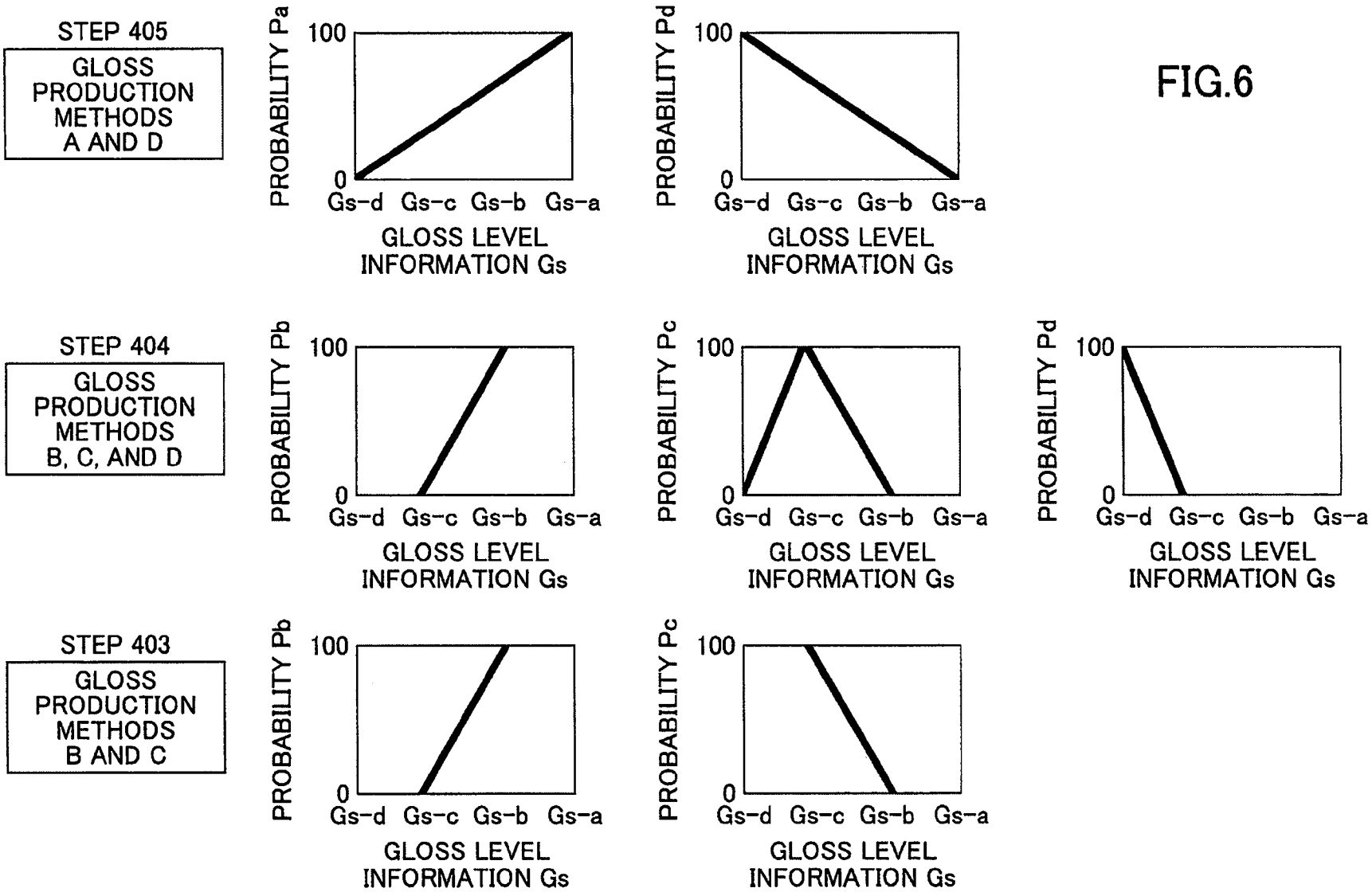
FIG. 6 illustrates graphs indicating the usage probability of the respective gloss production methods used in steps S403 through S405.

FIG. 6 illustrates graphs indicating the usage probability of the respective gloss production methods used in steps S403 through S405. In each graph, the horizontal axis indicates gloss level information Gs and the vertical axis indicates the usage probability of the respective gloss production method.

In step S405 of FIG. 4, when the gloss level information Gs is Gs=Gs-a, the probability is Pa=100%, and the gloss production method A is used for all pixels. Furthermore, when the gloss level information Gs is Gs=Gs-d, the probability is Pd=100%, and the gloss production method D is used for all pixels. Furthermore, both the gloss production method A and D are used in a case where the gloss level information Gs is Gs-a>Gs, and the probabilities are Pa and Pd, respectively. Specifically, a halftone dot forming method is performed by a conventional dither method. For example, an appropriate dither matrix Dij is created, with elements ranging from 0 through 100. Then, the probability Pa for the target pixel is compared with Dij. When Pa>Dij is satisfied, the gloss production method A is used, and when Pa>Dij is not satisfied, the gloss production method D is used.

In step S404 of FIG. 4, when the gloss level information Gs is Gs=Gs-b, Gs-c, and Gs-d, the probabilities are Pb=100%, Pc=100%, and Pd=100%, respectively, and the same gloss production method B, C, or D is used for all of the pixels. Furthermore, when the gloss level information Gs is Gs-b≧Gs≧Gs-c, both the gloss production method B and C are used, and the probabilities are Pb and Pc, respectively. Furthermore, when the gloss level information Gs is Gs-c>Gs≧Gs-d, both the gloss production method C and D are used, and the probabilities are Pc and Pd, respectively. Specifically, these methods can also be implemented by the conventional dither method.

In step S403 of FIG. 4, when the gloss level information Gs is Gs=Gs-b, Gs-c, the probabilities are Pb=100% and Pc=100%, respectively, and the same gloss production method B or C is used for all of the pixels. Furthermore, when the gloss level information Gs is Gs-b≧Gs≧Gs-c, both the gloss production method B and C are used, and the probabilities are Pb and Pc, respectively. Specifically, these methods can also be implemented by the conventional dither method.

Figure 7A:
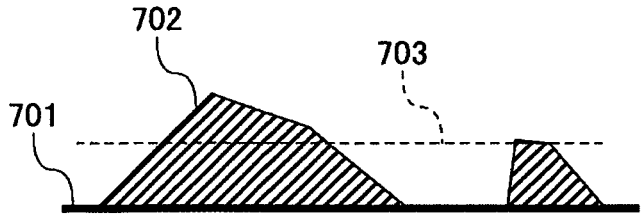
FIGS. 7A and 7B are cross-sectional views of images for describing the principle of producing gloss with the use of the gloss production methods A and B.
Figure 7B:
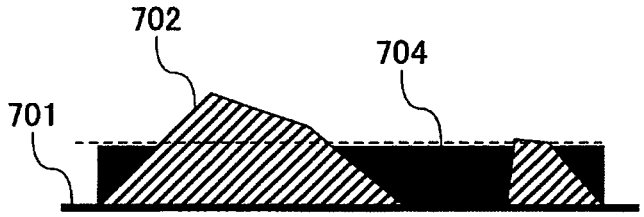

FIGS. 7A and 7B are cross-sectional views of images for describing the principle of producing gloss with the use of the gloss production methods A and B. As a matter of comparison, FIG. 7A illustrates a conventional YMCK four color image that is recorded only with the use of the color toner image forming device 201. As shown in FIG. 7A, a four color YMCK toner layer (color toner image) 702 is formed on a recording sheet 701. The adhering amount of four toner colors YMCK varies according to each pixel. The maximum height of toner protrusions on the image surface is approximately 15 μm, and the gloss level varies according to positions in the image. FIG. 7B illustrates a case where the gloss production methods A and B are used to produce gloss. In this example, an image is recorded with the use of the clear toner image forming device 202 when "inverse information" is set for the clear toner image information Clr as in FIG. 5. A target height 703 of the toner layer (toner layer target height 703) indicated by a horizontal dotted line in FIG. 7A is the target height of toner layer for evening out the overall amount of adhering toner. The target height may be, for example 10 μm. The term "inverse information" of the clear toner image information Clr is based on the following. That is, according to the conventional technology disclosed in patent documents 1 and 2, an inverse signal of the total of four toner colors YMCK signals is created, and this inverse signal is used as the clear toner image signal. Accordingly, an image is recorded as shown in FIG. 7B, including a clear toner layer (clear toner image) 704. By increasing the toner layer target height 703, the smoothness of the image surface can be enhanced; however, when the toner layer exceeds a certain thickness, the gloss level does not increase any further. Therefore, in practical situations, it is possible to stably express a gloss level Gs-b that is equivalent to that of a solid image, even if the toner layer target height 703 is somewhat reduced. In the gloss production method B, there is no need to subsequently use the gloss level increasing device 204, the second clear toner image forming device 205, or the second fixing device 206. Therefore, the contact/separation information SW and the second contact/separation information SW2 are set as "separate", so that the image is passed through and output without being processed by these devices. Accordingly, with the gloss production method B, the gloss level Gs-b can be stably produced. The gloss level Gs-b is typically approximately 60≧Gs-b≧20 (60 degree gloss level), although this may depend on the toner, the gloss level increasing device 204, or the type of sheet.

Meanwhile, in the gloss production method A, "contact" is set for the contact/separation information SW, and the image including the four color YMCK toner layer 702 and the clear toner layer 704 is passed through the gloss level increasing device 204, so that the gloss level of the entire image is increased. In the gloss production method A, there is no need to subsequently use the second clear toner image forming device 205 or the second fixing device 206. Therefore, the second contact/separation information SW2 is set as "separate", so that the image is passed through and output without being processed by these devices.

The principle of the gloss production method A is described in patent document 3, and is thus not further described herein. The gloss production method A can produce a significantly higher gloss level than the gloss level Gs-b of the gloss production method B. The gloss level Gs-a is typically approximately 100≧Gs-a≧80 (60 degree gloss level), although this may depend on the toner, the gloss level increasing device 204, or the type of sheet.

Figure 8A:
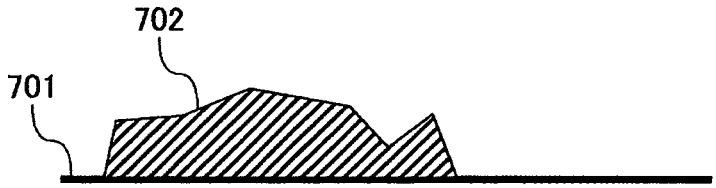
FIGS. 8A and 8B are cross-sectional views of images for describing the principle of producing gloss with the use of the gloss production method C.
Figure 8B:
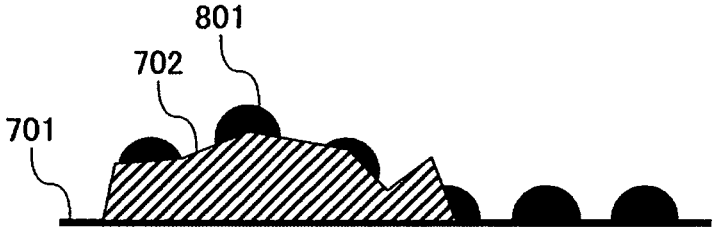

FIGS. 8A and 8B are cross-sectional views of images for describing the principle of producing gloss with the use of the gloss production method C. As a matter of comparison, FIG. 8A illustrates a conventional YMCK four color image that is recorded only with the use of the color toner image forming device 201. As shown in FIG. 8A, a four color YMCK toner layer 702 is formed on a recording sheet 701. FIG. 8B illustrates a case where the gloss production method C is used to produce gloss. In this example, an image is recorded with the use of the clear toner image forming device 202 when "halftone dots" are set for the clear toner image information Clr as in FIG. 5. As shown in FIG. 8B, halftone dots 801 are formed on the four color YMCK toner layer 702. Therefore, it is possible to reduce the gloss level of solid images parts where the gloss level is particularly high, or to reduce background parts when the sheet has a high gloss level. The method of forming the halftone dots 801 is the same as a conventional halftone dot forming method that is performed on color toner. However, in order to significantly reduce the gloss level, the amplitude between protrusions and recesses of the halftone dots needs to be increased. Therefore, the appropriate halftone dot area ratio with respect to the image is 30% through 50%, and the number of lines of halftone dots is preferably lower than the number of regular lines, at approximately 50 lines/inch through 100 lines/inch. In the gloss production method C, there is no need to subsequently use the gloss level increasing device 204, the second clear toner image forming device 205, or the second fixing device 206. Therefore, the contact/separation information SW and the second contact/separation information SW2 are set as "separate", so that the image is passed through and output without being processed by these devices.

The gloss level Gs-c produced by the gloss production method C can be typically reduced by approximately 30 with respect to the gloss level Gs-b (60 degree gloss level), although this may depend on the toner, the gloss level increasing device 204, or the type of sheet.

Figure 9A:
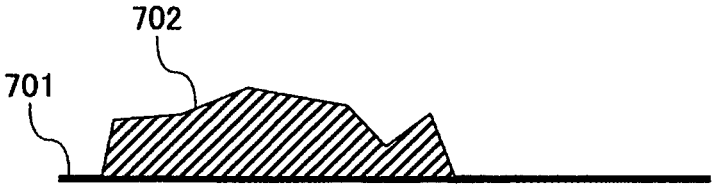
FIGS. 9A and 9B are cross-sectional views of images for describing the principle of producing gloss with the use of the gloss production method D.
Figure 9B:
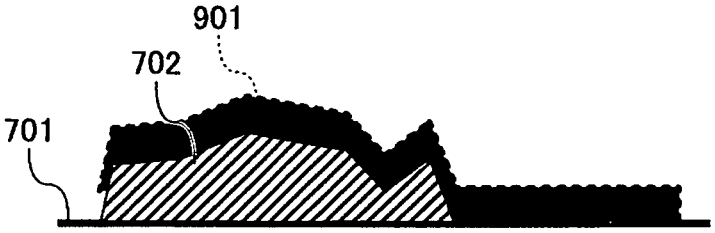

FIGS. 9A and 9B are cross-sectional views of images for describing the principle of producing gloss with the use of the gloss production method D. As a matter of comparison, FIG. 9A illustrates a conventional YMCK four color image that is recorded only with the use of the color toner image forming device 201. As shown in FIG. 9A, a four color YMCK toner layer 702 is formed on a recording sheet 701. FIG. 9B is a cross-sectional view of an image in which gloss is produced with the gloss production method D. In the gloss production method D, the clear toner image forming device 202 and the gloss level increasing device 204 are not needed as indicated in FIG. 5. Therefore, the clear toner image information Clr is set as 0% and the contact/separation information SW is set as "separate", so that the image passes through to the second clear toner image forming device 205, without being processed by the clear toner image forming device 202 or the gloss level increasing device 204. Meanwhile, the second contact/separation information SW2 is set as "contact", and the second clear toner image information Clr2 is set as 100%, i.e., a solid second clear toner image is set. Therefore, as shown in FIG. 9B, on the four color YMCK toner layer 702, the second clear toner image forming device 205 forms a clear toner solid image 901. Furthermore, the second fixing device 206 fixes the image at a lower temperature than a regular fixing temperature. Therefore, microscopic protrusions and recesses remain on the surface of the clear toner solid image 901. Accordingly, the gloss level is significantly reduced. The gloss level Gs-d expressed by the gloss production method D is typically approximately Gs-d=10 (60 degree gloss level), although this depends on the fixing conditions, the temperature, the speed, and the pressure.

According to the embodiments illustrated in FIGS. 1 through 9B, gloss can be reproduced continuously and across a wide range ranging from a low gloss level to a high gloss level, regardless of the reproduced colors in the image. Furthermore, the gloss level information Gs can be set for each pixel, and therefore an optional gloss level can be reproduced in an optional area in the image.

Figure 10:
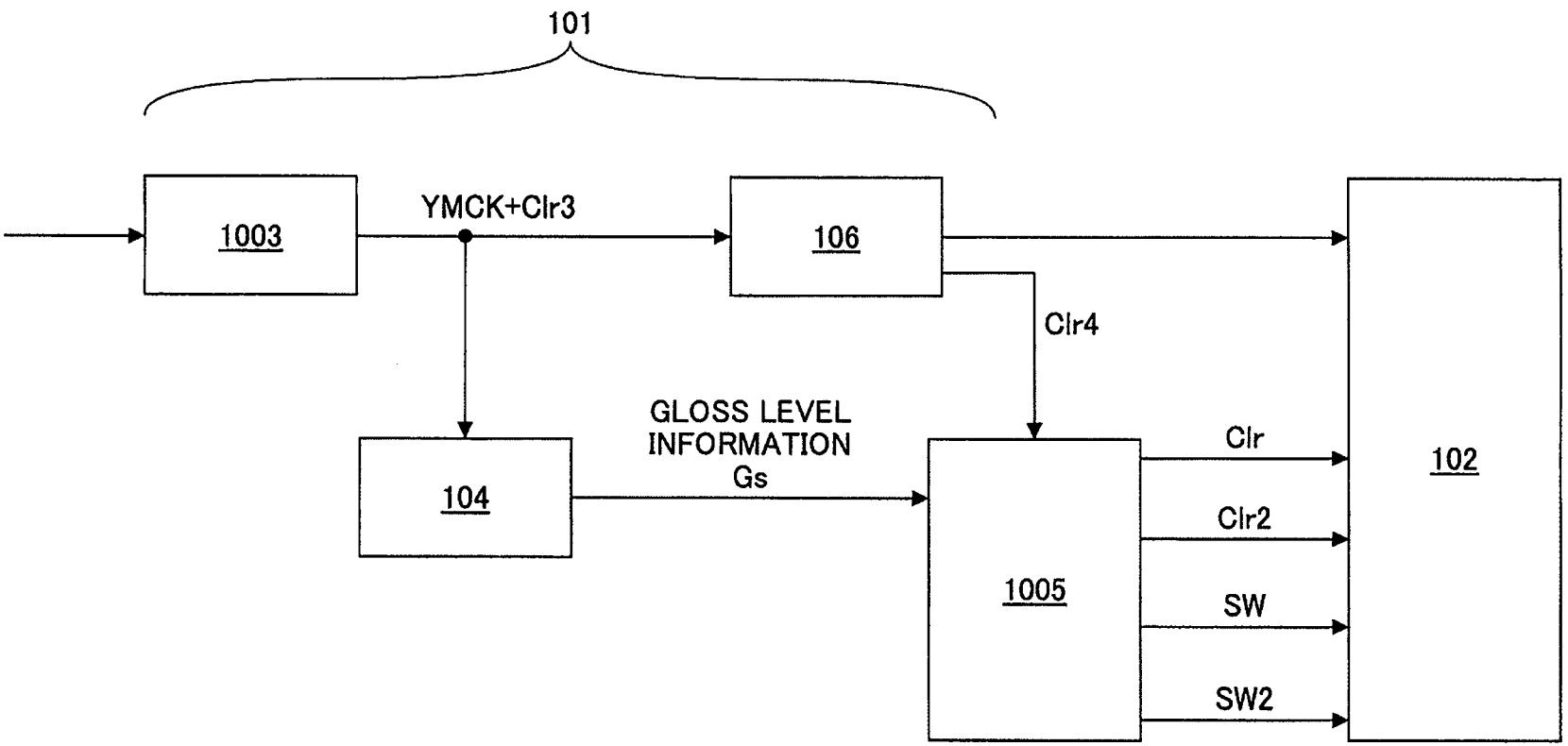
FIG. 10 is a schematic diagram of a color image forming apparatus according to another embodiment of the present invention.

FIG. 10 is a schematic diagram of a color image forming apparatus according to another embodiment of the present invention. In FIG. 10, elements corresponding to those of the color image forming apparatus shown in FIG. 1 are denoted by the same reference numerals and are not further described.

The color image forming apparatus shown in FIG. 10 includes a RIP unit 1003 that is different from the RIP unit 103 shown in FIG. 1. The RIP unit 1003 generates clear toner image information Clr3, in addition to gradation image information of four toner colors YMCK for each pixel. The clear toner image information Clr3 is different from the gloss level information Gs. Specifically, the clear toner image information Clr3 is information unrelated to controlling the gloss level of the image; the clear toner image information Clr3 is relevant to special purposes using clear toner, such as watermark images and texture images. The clear toner image information Clr3 is also digital information of 8 bits/pixel, similar to the YMCK image information described above. The clear toner image information Clr3 is basically used for controlling the amount of clear toner adhering to the image, similar to the YMCK image information described above. The clear toner image information Clr3 is converted into halftone dots, parallel lines, or FM screens by the screening processing unit 106, so that the clear toner image information Clr3 is converted into clear toner image information Clr4. The clear toner image information Clr4 is then input to a gloss production method determination processing unit 1005. The gloss production method determination processing unit 1005 performs processes using the gloss production method as described with reference to FIG. 4.

FIG. 11 indicates specific process contents of the gloss production methods used in steps S403 through S405 of FIG. 4, performed by the gloss production method determination processing unit 1005. The process contents include determining the probability (%) of using each gloss production method for a pixel, the clear toner image information Clr, the second clear toner image information Clr2, the contact/separation information SW, and the second contact/separation information SW2. The information is output to the printer engine 102. The difference between FIG. 11 and FIG. 5 is the process at the stage in the lowest row of the table in FIG. 5. In the embodiment illustrated in FIG. 5, when a pixel has gloss level information Gs=0, clear toner is not adhered in any of the steps S403 through S405 of FIG. 4, and therefore 0% is set for both the clear toner image information Clr and the second clear toner image information Clr2. Meanwhile, in the gloss production method determination processing unit 1005, even when a pixel has gloss level information Gs=0, clear toner image information Clr4 is input, and the clear toner image information Clr4 is used as the clear toner image information Clr (Clr=Clr4) and output to the printer engine 102.

According to the embodiment described with reference to FIGS. 10 and 11, in the parts of the image where the gloss level is not controlled (pixels having gloss level information Gs=0), image parts according to the clear toner image information Clr3 are recorded. Accordingly, the recorded image can include parts according to the clear toner image information Clr3 and parts according to the gloss level information Gs for controlling the gloss level. Thus, it is possible to record an image with even higher added value.

FIG. 12 indicates specific process contents of the gloss production methods used in steps S403 through S405 of FIG. 4, performed by a color image forming apparatus according to yet another embodiment of the present invention. The configuration of the color image forming apparatus according the present embodiment is the same as that of FIG. 10, and is thus not further described.

In the embodiment described with reference to FIGS. 10 and 11, there may be cases where an unintended image is formed. Specifically, when the gloss production methods A and D are used in step S405 of FIG. 4 and the target pixel has gloss level information Gs=0, an image corresponding to clear toner image information Clr (clear toner image information Clr3) formed by the clear toner image forming device 202 passes through the gloss level increasing device 204. Consequently, an unintended image may be formed. Particularly, when the clear toner image information Clr3 corresponds to a texture in which importance is placed on the protrusions and recesses, the protrusions and recesses may be eliminated when the image passes through the gloss level increasing device 204. Furthermore, when the clear toner image information Clr3 corresponds to a watermark image in which importance is placed on the density, the gradations in the image may be eliminated when the image passes through the gloss level increasing device 204.

In the embodiment illustrated in FIG. 12, in the gloss production method used in step S405 of FIG. 4, the contact/separation information SW for the gloss level increasing device 204 is set as "contact", and therefore the gloss level increasing device 204 performs the process of increasing the gloss level. In this case, as shown in FIG. 12, the parts of the image where the gloss level is not controlled (pixels having gloss level information Gs=0), the clear toner image information is set as Clr=0%, and the second clear toner image information is set as Clr2=Clr4 instead of Clr2=0. Otherwise, in the gloss production methods used in steps S403 and S404 of FIG. 4, the same operations as those of FIG. 11 are performed.

According to the embodiment of FIG. 12, in the parts of the image where the gloss level is not controlled (pixels having gloss level information Gs=0) in step S405 of FIG. 4, a clear toner image is formed by the second clear toner image forming device 205 positioned on the downstream side of the gloss level increasing device 204, and are therefore not processed by the gloss level increasing device 204. Accordingly, the protrusions and recesses and the density of the image corresponding to the clear toner image information Clr3 can be faithfully reproduced. Thus, it is possible to record an image with added value.

According to the embodiments described above, in the color toner image forming device 201 (color toner image forming means), at least one of plural different color toners is used to form a color toner image (color toner image in which predetermined colors are reproduced) on a recording sheet (recording medium). The clear toner image forming device 202 (first colorless transparent toner image forming means) forms a first clear toner image on a color toner image on the recording sheet, with the use of clear toner (colorless transparent toner). Then, the fixing device 203 (first fixing means) fixes the color toner image and the first clear toner image on the recording sheet. Accordingly, a glossy color image can be formed on the recording sheet. Subsequently, the gloss level increasing device 204 (gloss level increasing means) increases the gloss level evenly across the entire color image on the recording sheet. The second clear toner image forming device 205 (second colorless transparent toner image forming means) applies clear toner to an optional part where the gloss level is to be reduced, so that a second clear toner image (second colorless transparent toner image) is formed. Then, the second fixing device 206 (second fixing means) fixes the part of the second clear toner image so as to have a low gloss level. Thus, the optional area of the image where a predetermined color is reproduced can be made to have a low gloss level. Furthermore, by adjusting the area ratio of the second clear toner image, the gloss level can vary continuously between a low gloss level and a high gloss level. Accordingly, a wide range of gloss levels can be reproduced from a low gloss level to a high gloss level, regardless of the reproduced colors. Furthermore, in an optional area in the image, it is possible to reproduce an optional gloss level specified within the wide range of gloss levels.

According to the embodiments described above, the color image forming apparatus includes the gloss level increasing device 204 for causing rollers used for sandwiching a sheet to contact/separate, so that the gloss level increasing device 204 may or may not perform the process of increasing the gloss level. Furthermore, the color image forming apparatus includes the second contact-separation mechanism 210 for causing rollers used for sandwiching a sheet to contact/separate, so that the second clear toner image forming device 205 may or may not perform the process of forming a second clear toner image and the second fixing device 206 may or may not perform the process of fixing the second clear toner image. According to the contact-separation mechanism 209 and the second contact-separation mechanism 210, in cases where images can be formed without using the gloss level increasing device 204, the second clear toner image forming device 205, or the second fixing device 206, the images can pass through without being processed by these devices. Consequently, it is possible to mitigate attrition of elements and to prevent the image quality from degrading.

According to the embodiments described above, the gloss level information attachment proceeding unit 104 (gloss level information attachment means) attaches gloss level information corresponding to respective pixels, to pixel information included in image information of a color toner image to be formed on a recording sheet with the use of at least one of plural color toners. The gloss production method determination processing unit 105 (gloss production method determination means) determines, for each pixel, the gloss production method to be used among plural types of gloss production methods A through D. Then, the printer controller 101 (control means) controls the gloss production method determination processing unit 105 to execute the determined gloss production method. By selecting the appropriate gloss production method according to the gloss level information of each pixel, the gloss level may continuously vary between a low gloss level and a high gloss level in optional areas.

According to the embodiments described above, in a case where the gloss production method determination processing unit 105 has not determined the gloss production method, after the fixing device 203 fixes the color toner image that has been formed on the recording sheet by the color toner image forming device 201, the printer controller 101 (control means) performs a control operation of not executing any of the plural gloss production methods A through D. According to this control operation, the range of gloss levels that can be produced can be made even wider.

According to the embodiments described above, the color image forming apparatus includes the gloss production methods A and B that can be determined for each pixel. Specifically, with the use of the gloss production methods A and B, the clear toner image forming device 202 forms a clear toner image such that the total value of the layer thickness of the color toner image and the layer thickness of the clear toner image is a constant value. Accordingly, the image surface becomes smooth, so that an image having a high gloss level can be produced.

According to the embodiments described above, the color image forming apparatus includes the gloss production method C that can be determined for each pixel. Specifically, with the use of the gloss production method C, the clear toner image forming device 202 forms a clear toner image with halftone dots having a predetermined wavelength and a predetermined amplitude. Accordingly, appropriate roughness is formed on the image surface, and the reflection light is scattered by the roughness, so that a low gloss level can be produced in accordance with the gloss level information of each pixel.

According to the embodiments described above, the color image forming apparatus includes the gloss production method D as the gloss production method that can be determined for each pixel. Specifically, with the use of the gloss production method D, the clear toner image forming device 202 forms a toner image having a predetermined thickness. Accordingly, the second fixing device 206 can easily form a low gloss level surface on the toner image having a predetermined thickness, so that the gloss level can be reduced.

According to the embodiments described above, when an image corresponding to one page of a recording sheet includes a pixel having a gloss level that is higher than a gloss level that can be produced by the gloss production method B, the gloss production method determination processing unit 105 determines to use the gloss production methods A and D to form the image corresponding to one page. In this case, even if the gloss level increasing device 204 has increased the gloss level evenly across the entire image, the second clear toner image forming device 205 can apply a second clear toner to parts where the gloss level is to be reduced, and the second fixing device 206 can fix the image such that the second clear toner has a low gloss level. Accordingly, it is possible to make an optional area in an image have a low gloss level.

According to the embodiments described above, when an image corresponding to one page of a recording sheet does not include any pixels having gloss level information higher than the gloss level that can be produced by the gloss production method B, and the image corresponding to one page includes pixels having gloss level information lower than the gloss level that can be produced by the gloss production method. C, the gloss production method determination processing unit 105 determines to use gloss production methods B, C, and D to form the image. In this case, it is possible to reduce the cost per page because the gloss level increasing device 204 does not perform the process on an image that does not include any high gloss level portions that need to be processed by the gloss level increasing device 204.

According to the embodiments described above, when an image corresponding to one page of a recording sheet does not include any pixels having gloss level information higher than the gloss level that can be produced by the gloss production method B, and the image corresponding to one page does not include any pixels having gloss level information lower than the gloss level that can be produced by the gloss production method C, the gloss production method determination processing unit 105 determines to use gloss production methods B and C to form the image. In this case, it is possible to reduce the cost per page because the gloss level increasing device 204, the second clear toner image forming device 205, and the second fixing device 206 do not perform any processes on an image that does not include any high gloss level portions that need to be processed by the gloss level increasing device 204 or any low gloss level portions that need to be processed by the second clear toner image forming device 205 and the second fixing device 206.

According to the embodiments described above, the gloss level information attachment proceeding unit 104 attaches gloss level information corresponding to respective pixels, to pixel information included in image information of an image to be formed on a recording sheet with the use of at least one of plural color toners and clear toner. The gloss production method determination processing unit 105 determines the gloss production method for each pixel based on the gloss level information and the clear toner image information Clr3 including pixel information of clear toner. In this case, the gloss production method can be determined based on both the clear toner image information Clr3 and the gloss level information Gs used for controlling the gloss level. Therefore, an image having added value can be formed by forming a clear toner layer based on the clear toner image information Clr3 and controlling the gloss level.

According to the embodiments described above, in a case where the gloss production method determination processing unit 105 has not determined the gloss production method, after the fixing device 203 fixes the color toner image that has been formed on the recording sheet by the color toner image forming device 201 and the clear toner image formed on the recording sheet by the clear toner image forming device 202, the printer controller 101 (control means) performs a control operation of not executing any of the plural gloss production methods A through D. According to this control operation, at the part of the image where the gloss level is not controlled (pixels having gloss level information of Gs=0), a clear toner image is recorded based on the clear toner image information Clr3. Accordingly, the recorded image can include parts according to the clear toner image information Clr3 and parts according to the gloss level information Gs for controlling the gloss level. Thus, it is possible to record an image with even higher added value.

According to the embodiments described above, in a case where an image corresponding to one page of a recording sheet includes a pixel having a gloss level that is higher than a gloss level that can be produced by the gloss production method B, after the fixing device 203 fixes the color toner image that has been formed on the recording sheet by the color toner image forming device 201 and after the gloss level increasing device 204 increases the gloss level of the entire image, the printer controller 101 (control means) controls the second clear toner image forming device 205 to form a second clear toner image on the image recorded on the recording sheet and controls the second fixing device 206 to fix the second clear toner image. According to this control operation, the clear toner image corresponding to the clear toner image information Clr4 generated based on the clear toner image information Clr3, is formed by the second clear toner image forming device 205 that is on the downstream side of the gloss level increasing device 204. This clear toner image is not processed by the gloss level increasing device 204. Accordingly, the roughness on the surface of the clear toner image corresponding to the clear toner image information Clr4 and the image density can be faithfully reproduced. Thus, it is possible to record an image with even higher added value.

According to an embodiment of the present invention, an optional area in an image reproducing predetermined colors can be made to have a low gloss level. Furthermore, the gloss level can continuously vary between a low gloss level and a high gloss level. Accordingly, a wide range of gloss levels can be reproduced from a low gloss level to a high gloss level, regardless of the reproduced colors. Furthermore, in an optional area in the image, it is possible to reproduce an optional gloss level specified within the wide range of gloss levels.

First Embodiment

A description is given of a first embodiment of the present invention, relevant to forming images in cases where photographic images and low gloss level images are included in the same image, or where photographic images and three-dimensional images are included in the same image. First, a detailed description is given of a method of creating a photographic image with reference to FIG. 2 illustrating the printer engine 102.

First, the color toner image forming device 201 creates an image based on color image information. In order to make the entire image have the quality of a photograph with the use of the gloss level increasing device 204, the clear toner image forming device 202 needs to create an image at parts where there are no images. The principle of the gloss level increasing device 204 is as follows. First, the toner on a sheet is melted. Then, in order to produce photographic gloss, the surface of the toner image is turned into a mirror-like surface with the use of a belt having high specularity (mirror-like properties). For this reason, the clear toner image forming device 202 needs to create a clear image at parts where there is no color toner.

For the purpose of turning the image surface into a mirror-like surface, the toner particle size is preferably the same as that of the color toner, so that the surface can be made smooth. When a three-dimensional image is formed, photographic gloss cannot be attained only with the use of the color toner image forming device 201, the clear toner image forming device 202, and the gloss level increasing device 204. Conversely, when a photographic image is formed, a three-dimensional image cannot be formed.

Therefore, in the present embodiment, the second clear toner image forming device 205 is used.

Next, a description is given of an operation of printing three-dimensional parts in an image, performed by the second clear toner image forming device 205.

In the present embodiment, the second clear toner image forming device 205 uses clear toner particles having particle sizes that are larger than that of the toner used by the clear toner image forming device 202. The clear toner used by the clear toner image forming device 202 preferably has the same particle size as the color toner, as described above. The particle size of color toner cannot be increased significantly, because it is preferable that the color toner is not felt when touched. Therefore, when the clear toner used for forming the second clear toner image has the same particle size as that of the first clear toner, the images may not be felt when touched. Furthermore, in the case of the color toner image forming device 201, failures may occur as a result of using large toner particles (for example, transfer failures and fixing failures may occur if the toner particles are too large, because toner of four colors are transferred and fixed at once). Meanwhile, with the second clear toner image forming device 205, toner of only one color is used, and therefore a smaller amount of toner is subjected to the transfer process and fixing process. Consequently, it is possible to use toner particles having larger sizes, so that more effective three-dimensional images can be formed.

As described above, by using the image forming apparatus according to the present embodiment, it is possible to create photographic images and highly effective three-dimensional images in the same image, without the need of first creating a photographic image and then passing the image through an image forming apparatus once again.

Second Embodiment

Next, a description is given of a second embodiment of the present invention. The basic configuration of the image forming apparatus is the same as that of the first embodiment, and is thus not further described.

Figure 13:
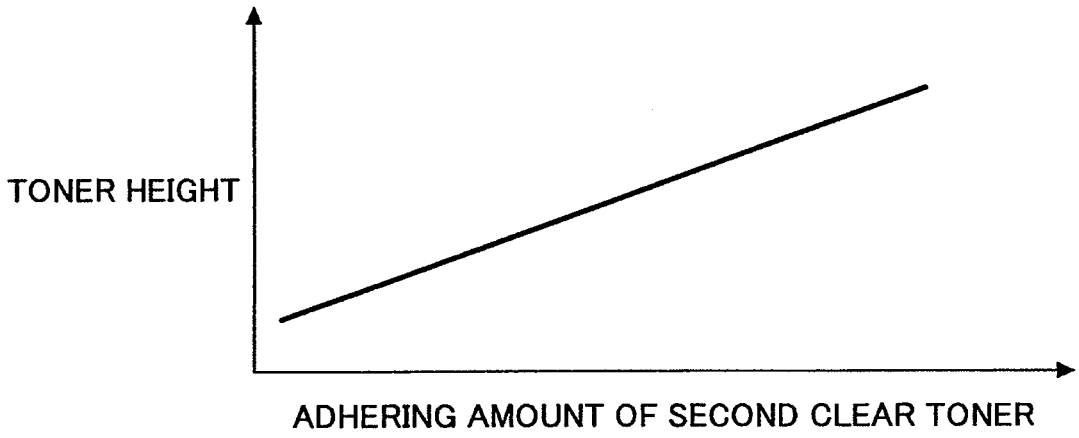
FIG. 13 is a graph indicating the adhering amount of second clear toner and the toner height according to an embodiment of the preset invention.

As shown in FIG. 13, the adhering amount of the second clear toner and the height of the toner are related to each other. By changing the adhering amount of the second clear toner used at the second clear toner image forming device 205, it is possible to create a three-dimensional image which can be felt when touched, having an optional height as requested by the user. In order to form a higher three-dimensional image, the amount of applied toner is increased. When there is no need to feel the image, the amount of applied toner is reduced.

As described above, by changing the adhering amount of second clear toner, the height of the toner can be freely changed. Consequently, it is possible to form a three-dimensional image in accordance with the user's request.

Third Embodiment

Next, a description is given of a third embodiment of the present invention. The basic configuration of the image forming apparatus is the same as that of the first embodiment, and is thus not further described.

Figure 14:
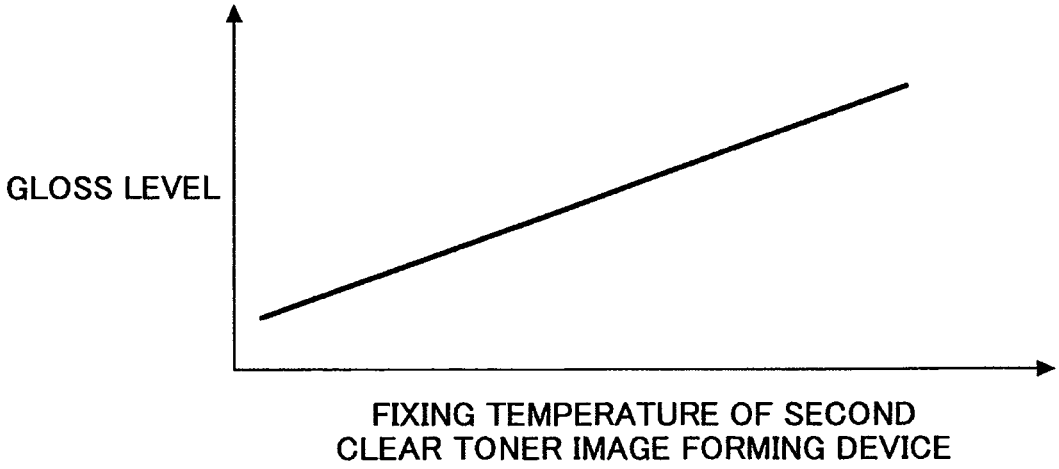
FIG. 14 is a graph indicating the fixing temperature of a second clear toner image forming device and the gloss level according to an embodiment of the preset invention.

As shown in FIG. 14, the fixing temperature of heat applied to the second clear toner and the image gloss level are related to each other. By changing the fixing temperature used at the second clear toner image forming device 205, it is possible to adjust the gloss level of a part of the image to a low gloss level.

As described above, by changing the fixing temperature of heat applied to the second clear toner, the gloss level can be freely changed. Consequently, it is possible to form a three-dimensional image in accordance with the user's request.

Fourth Embodiment

Next, a description is given of a fourth embodiment of the present invention. The basic configuration of the image forming apparatus is the same as that of the first embodiment, and is thus not further described.

The fourth embodiment is relevant to forming images in cases where photographic images and low gloss level images are included in the same image, or where photographic images and three-dimensional images are included in the same image. First, a detailed description is given of a method of creating a photographic image.

First, the color toner image forming device 201 creates an image based on color image information. In order to make the entire image have the quality of a photograph with the use of the gloss level increasing device 204, the clear toner image forming device 202 needs to create a clear image at parts where there are no images. The principle of the gloss level increasing device 204 is as follows. First, the toner on a sheet is melted. Then, in order to produce photographic gloss, the surface of the toner image is turned into a mirror-like surface with the use of a belt having high specularity. For this reason, the clear toner image forming device 202 needs to create a clear image at parts where there is no color toner.

For the purpose of turning the image surface into a mirror-like surface, the toner particle size is preferably the same as that of the color toner, so that the surface can be made smooth. When a three-dimensional image is formed, photographic gloss cannot be attained only with the use of the color toner image forming device 201, the clear toner image forming device 202, and the gloss level increasing device 204. Conversely, when a photographic image is formed, a three-dimensional image cannot be formed.

Therefore, in the present embodiment, the second clear toner image forming device 205 is used. Next, a description is given of an operation of printing three-dimensional parts in an image, performed by the second clear toner image forming device 205.

In the present embodiment, heat foaming toner is used as the second clear toner. The clear toner used at the clear toner image forming device 202 preferably has the same particle size as that of the color toner, as described above. The particle size of color toner cannot be increased extensively, because it is preferable that the color toner is not felt when touched. Therefore, when the first clear toner is used for forming the second clear toner image, the images cannot be sufficiently felt when touched. Furthermore, Braille characters need to have a height of greater than or equal to 300 μm, which are difficult to form with regular clear toner. However, by using the heat foaming toner of the present embodiment, Braille printing can be performed.

As described above, by using the image forming apparatus according to the present embodiment, it is possible to create photographic images and highly effective three-dimensional images in the same image, without the need of first creating a photographic image and then passing the image through the image forming apparatus once again.

Fifth Embodiment

Next, a description is given of a fifth embodiment of the present invention. The basic configuration of the image forming apparatus is the same as that of the first embodiment, and is thus not further described.

Figure 15:
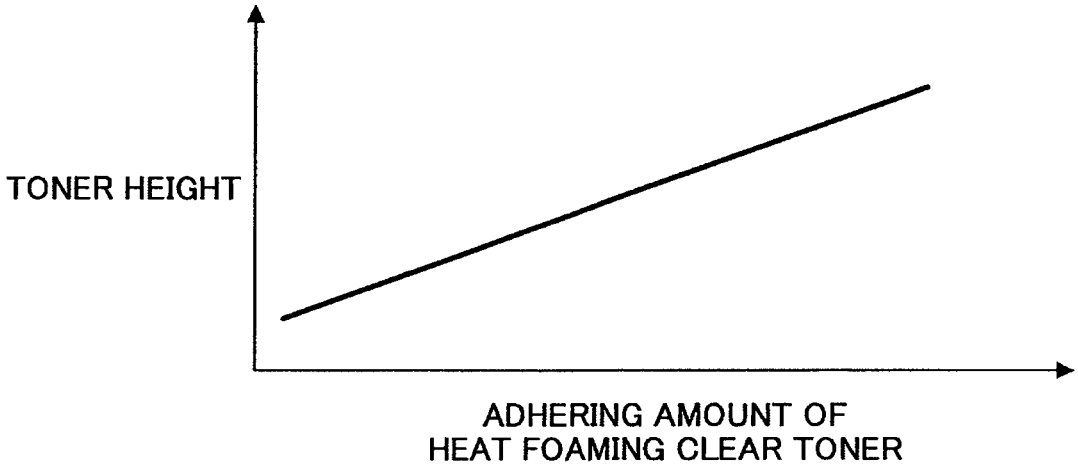
FIG. 15 is a graph indicating the adhering amount of heat foaming toner and the toner height according to an embodiment of the preset invention.

As shown in FIG. 15, when heat foaming toner is used as the second clear toner, the amount of adhering heat foaming toner and the height of the toner are related to each other. The more the amount of adhering heat foaming toner, the higher the height of the toner. Therefore, by changing the amount of adhering clear toner at the second clear toner image forming device 205, it is possible to create a three-dimensional image having an optional height according to the user's request, as an image that can be felt when touched. A three-dimensional image having a higher height can be formed by increasing the adhering amount of toner even more. An image that does not need to be felt when touched can be formed by reducing the adhering amount of toner.

As described above, by changing the adhering amount of second clear toner, it is possible to freely change the extent to which the images can be felt.

Sixth Embodiment

Next, a description is given of a sixth embodiment of the present invention. The basic configuration of the image forming apparatus is the same as that of the first embodiment, and is thus not further described.

Figure 16:
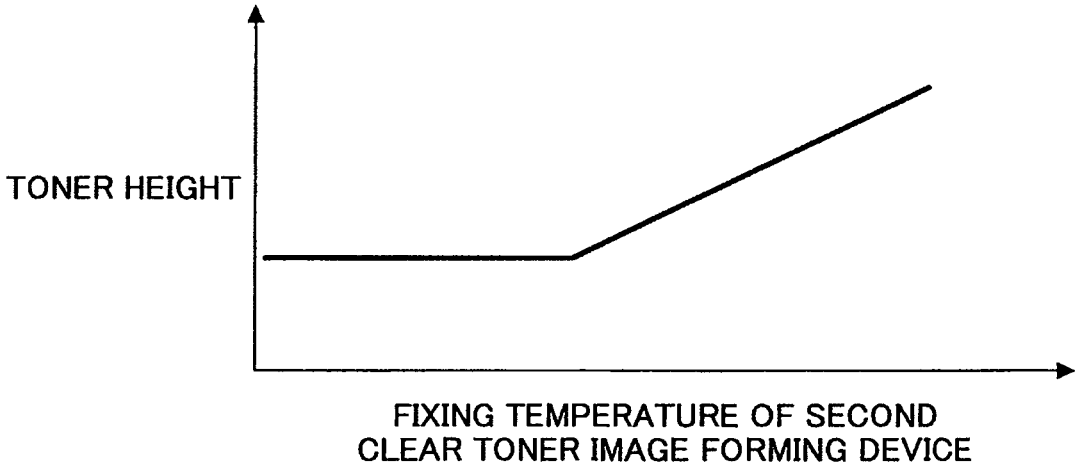
FIG. 16 is a graph indicating the fixing temperature of the second clear toner image forming device and the toner height according to an embodiment of the preset invention.

As shown in FIG. 16, the fixing temperature of heat applied to the heat foaming toner and the toner height are related to each other. Therefore, by changing the fixing temperature at the second clear toner image forming device 205, the toner height can be changed to an optional height. By increasing the fixing temperature, a toner height of greater than or equal to 300 μm can be attained, so that Braille printing can be performed. Conversely, by decreasing the fixing temperature, the heat foaming toner can be prevented from foaming, so that the feeling of the heat foaming toner is about the same as that of clear toner. Accordingly, the image height can be optionally changed in accordance with the user's request.

As described above, by changing the fixing temperature applied to the second clear toner, it is possible to freely change the image height.

Seventh Embodiment

Next, a description is given of a seventh embodiment of the present invention. The basic configuration of the image forming apparatus is the same as that of the first embodiment, and is thus not further described.

Figure 17A:
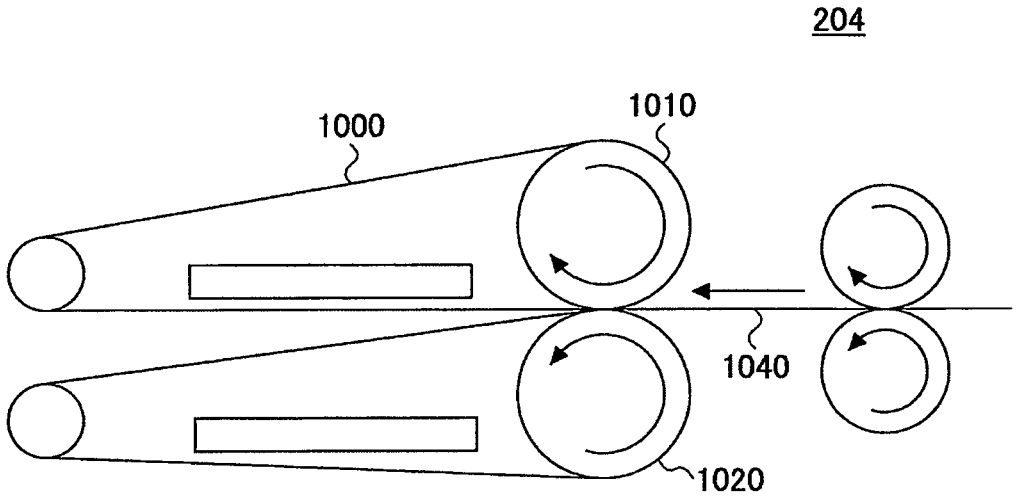
FIGS. 17A and 17B are for describing a gloss level increasing device according to a seventh embodiment of the present invention.
Figure 17B:
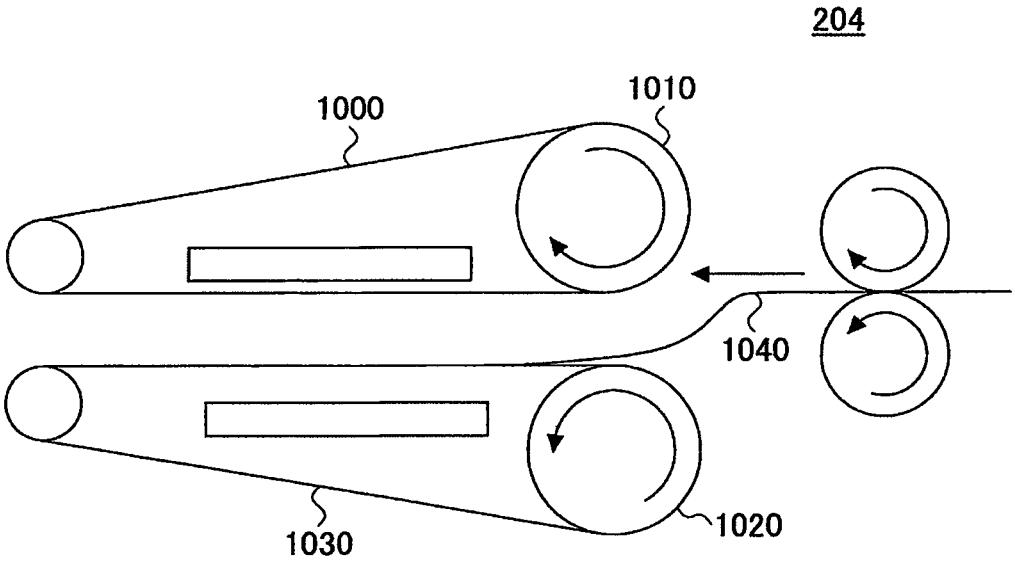

A detailed description is given of the gloss level increasing device 204 according to the present embodiment with reference to FIGS. 17A and 17B. First, a description is given of printing an image having photographic image quality. When printing a photographic image, as shown in FIG. 17A, a sheet 1040 that has passed through the fixing device 203 is received by the gloss level increasing device 204 in a state where a pressurizing roller 1020 used when remelting the toner is contacting a heating roller 1010 for remelting the toner. Then, the heating roller 1010 and the pressurizing roller 1020 are used to remelt the toner on the sheet 1040. Subsequently, to turn the image surface into a mirror-like surface, the image on the sheet 1040 is caused to come in close contact with a cooling/peeling belt 1000 having a mirror surface. In this process, the sheet 1040 and the cooling/peeling belt 1000 are adhered to each other by the melted toner, and therefore the sheet does not fall down even if it is not supported from below. Furthermore, air is blown from behind the cooling/peeling belt 1000 to cool the toner while the sheet 1040 is being conveyed by the cooling/peeling belt 1000, so that the toner on the image surface is fixed (solidified). A photographic image can be created in the above manner.

Next, a description is given of a case where a photographic image is not printed with the image forming apparatus. When photographic images are not printed, as shown in FIG. 17B, the sheet 1040 that has passed through the fixing device 203 is received in a state where the pressurizing roller 1020 used when remelting the toner is separated from the heating roller 1010 for remelting the toner. In this instance, the sheet 1040 is not sandwiched by the heating roller 1010 and the pressurizing roller 1020, and therefore the sheet 1040 drops down due to gravity. Consequently, the toner on the sheet does not contact the heating roller 1010, and therefore the toner is not remelted. Furthermore, a conveying belt 1030 receives the sheet 1040 that has dropped due to gravity, and the conveying belt 1030 conveys the sheet 1040 to the second clear toner image forming device 205.

According to the present embodiment, even when photographic images and images other than photographic images are alternately printed, the printing productivity does not decrease. Furthermore, these images can be formed without the need of a complex mechanism, such as providing different conveying paths for different types of images. In the conventional technology, when photographic images and low gloss level images are printed alternately one sheet at a time, the sheet conveying path needs to be changed each time an image is printed. Therefore, it is difficult to alternately convey these images to the second clear toner image forming device without reducing the printing productivity. Furthermore, in the conventional technology, a subsequent printing operation or a post process cannot be continuously performed because the photographic images and the low-gloss-level sheets are ejected to different sheet eject trays; however, this problem can be overcome with the present embodiment.

Eighth Embodiment

Next, a description is given of an eighth embodiment of the present invention. The basic configuration of the image forming apparatus is the same as that of the seventh embodiment, and is thus not further described.

There are cases where the sheet 1040 has not completely cooled down and the toner is not solidified, when the sheet 1040 reaches the second clear toner image forming device 205 after passing through the gloss level increasing device 204. In this case, failures may occur in the transfer unit of the second clear toner image forming device 205.

In a case where a photographic image is printed, the sheet 1040 is conveyed to the second clear toner image forming device 205 by the cooling/peeling belt 1000 (cooling/peeling device). Therefore, the sheet 1040 is sufficiently cooled down by the time it reaches the second clear toner image forming device 205, so that the second clear toner image forming device 205 can perform printing on the sheet 1040 without any problem. However, in a case where an image other than photographic images is printed, the sheet 1040 is not processed by any particular cooling mechanism in the seventh embodiment. Therefore, the sheet 1040 may enter the second clear toner image forming device 205 in a state where the toner has not yet solidified.

However, in the present embodiment, air is also blown from behind the conveying belt 1030. Therefore, even in a case where an image other than photographic images is printed, the sheet 1040 can enter the second clear toner image forming device 205 after it has completely cooled down. Accordingly, printing operations can be stably performed. It is assumed that the cooling air is blown in a direction in which the sheet 1040 closely contacts the conveying belt 1030.

Ninth Embodiment

Next, a description is given of a ninth embodiment of the present invention. The basic configuration of the image forming apparatus is the same as that of the seventh embodiment, and is thus not further described.

Figure 18:
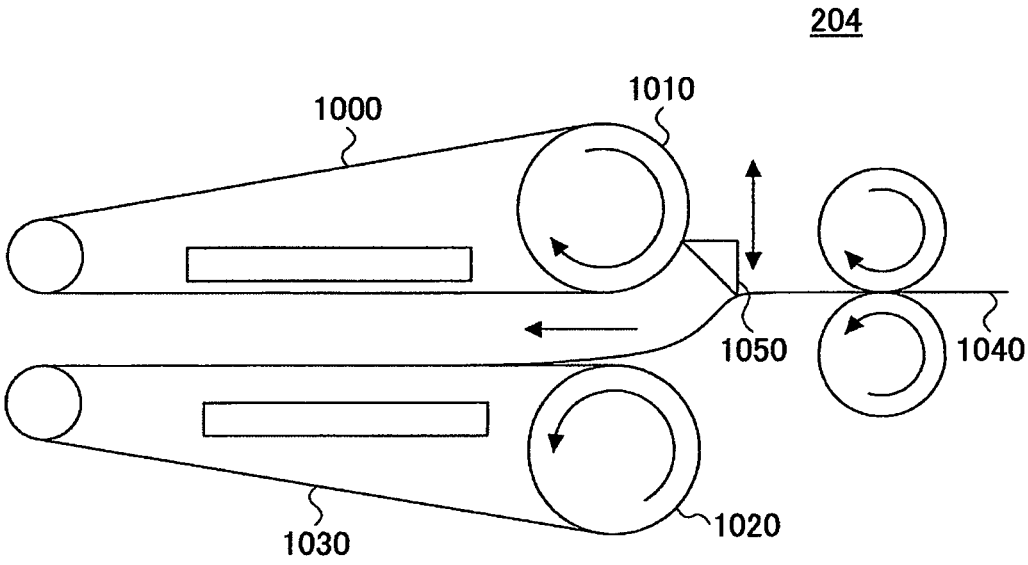
FIG. 18 is for describing a structure including a sheet guide according to an embodiment of the present invention.

In a case where the sheet 1040 enters the gloss level increasing device 204 when an image other than photographic images is printed, the gloss level increasing device 204 is in a state as shown in FIG. 17B. Therefore, the sheet 1040 is received and conveyed by the conveying belt 1030 due to gravity. In this case, the position of the sheet 1040 may vary widely according to the stiffness of the sheet 1040. When the stiffness of the sheet 1040 is particularly high, the sheet 1040 may not fall due to gravity, and may not be properly placed on the conveying belt 1030. Accordingly, as shown in FIG. 18, the present embodiment includes a sheet guide 1050 that moves up and down in accordance with the stiffness of sheet 1040. Thus, the sheet 1040 is stably conveyed onto the conveying belt 1030 regardless of the stiffness of the sheet 1040.

When the stiffness of the sheet 1040 is high, the sheet guide 1050 is significantly lowered so that the sheet 1040 does not contact the heating roller 1010. When the stiffness of the sheet 1040 is low, the sheet guide 1050 is not excessively lowered so that the sheet 1040 does not fall down. According to the above method, the sheet 1040 can be conveyed to the conveying belt 1030 along a constantly stabilized sheet path, regardless of the stiffness of the sheet 1040.

Tenth Embodiment

In the ninth embodiment, the stiffness of the sheet 1040 may vary according to the environment and the thickness of the sheet. Generally, the stiffness is high when the sheet is thick and dry. Conversely, the stiffness is low when the sheet is thin and moist. Thus, in the present embodiment, these conditions are acquired from the color toner image forming device 201 before the sheet 1040 enters the gloss level increasing device 204, and the extent of moving up/down the sheet guide 1050 (sheet guide movement amount) is determined based on the acquired results. Accordingly, the sheet 1040 can be conveyed along a stable sheet path to be properly placed on the conveying belt 1030.

For example, a humidity sensor may be provided in the sheet tray to measure the humidity during the printing operation. As to the sheet thickness, the user may input, into the main unit of the apparatus, the sheet thickness information of the sheet set in the sheet tray. A table indicating the relationship between the sheet thickness, the moisture, and the sheet guide movement amount may be stored in an information recording medium in the apparatus main unit in advance. The sheet guide movement amount may be determined based on this table, in accordance with the measured moisture and the specified sheet thickness.

Eleventh Embodiment

In the ninth embodiment, the stiffness of the sheet 1040 may vary according to the environment and the thickness of the sheet. Generally, the stiffness is high when the sheet is thick and dry. Conversely, the stiffness is low when the sheet is thin and moist. Thus, in the present embodiment, the moisture content of the sheet is measured in order to acquire the stiffness of the sheet. Generally, the moisture content of the sheet and the stiffness of the sheet have the following relationship. The lower the moisture content of the sheet, the higher the stiffness of the sheet. Conversely, the higher the moisture content of the sheet, the lower the stiffness of the sheet. Immediately before the sheet 1040 enters the gloss level increasing device 204, the moisture content of the sheet 1040 is measured. Based on the measured moisture content and the sheet thickness, the extent of moving up/down the sheet guide 1050 (sheet guide movement amount) is determined. Accordingly, the sheet 1040 can be conveyed along a stable sheet path to be properly placed on the conveying belt 1030.

An example of a method of measuring the moisture content is obtaining the moisture content based on the electrical resistivity of the sheet described below.

Twelfth Embodiment

The electrical resistivity of the sheet is measured to acquire the stiffness information of the sheet of the ninth embodiment. The higher the electrical resistivity, the lower the moisture content of the sheet; the lower the moisture content of the sheet, the higher the stiffness of the sheet. Accordingly, by measuring the electrical resistivity of the sheet, the sheet stiffness can be estimated. This is advantageous in that it is easier to measure the electrical resistivity than to measure the moisture content.

Immediately before the sheet 1040 enters the gloss level increasing device 204, the electrical resistivity of the sheet 1040 is acquired. Based on the acquired electrical resistivity and the sheet thickness, the extent of moving up/down the sheet guide 1050 (sheet guide movement amount) is determined. Accordingly, the sheet 1040 can be conveyed along a stable sheet path to be properly placed on the conveying belt 1030.

Figure 19:
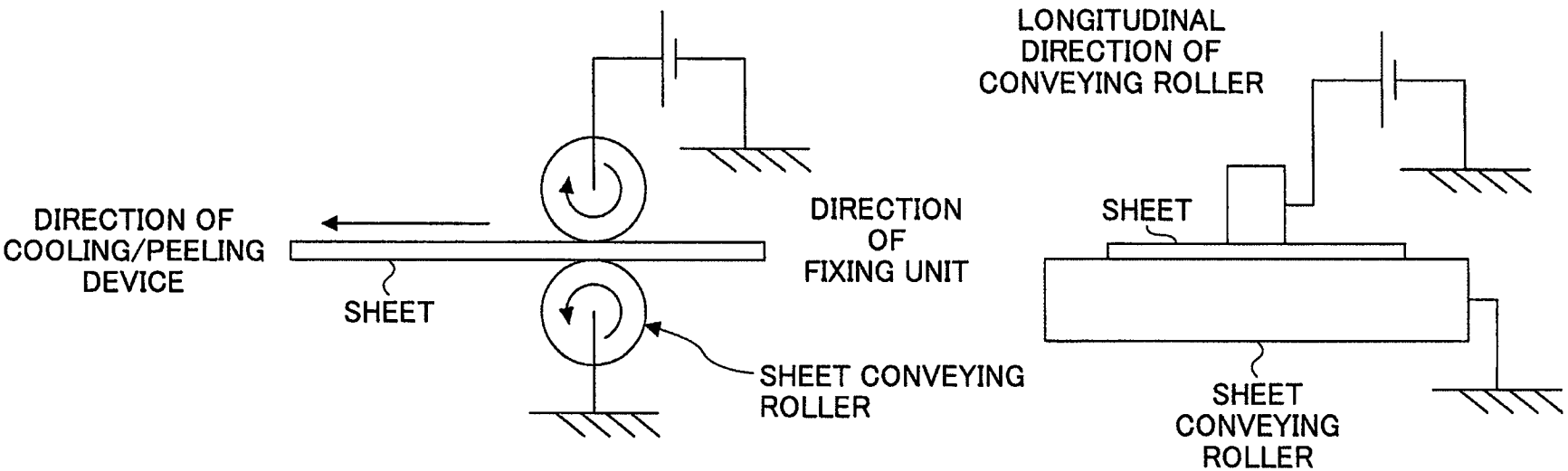
FIG. 19 is for describing a method of obtaining the resistivity by applying a voltage according to a twelfth embodiment of the present invention.

The electrical resistivity is obtained by applying a voltage as shown in FIG. 19. Referring to FIG. 19, the length of the roller to which a voltage is applied (upper roller in FIG. 19) is set such that the entire length of the roller in the longitudinal direction comes in contact with a sheet of any size. This is because if the length of the roller in the longitudinal direction is greater than the width of the sheet passing through, the voltage application roller and the sheet conveying roller directly contact each other, and the electrical resistivity of the sheet cannot be properly measured. The electrical resistivity can be estimated by applying a voltage during printing and measuring the current value. The device for measuring the electrical resistivity is positioned between the fixing device 203 and the cooling/peeling device (cooling/peeling belt 1000).

Thirteenth Embodiment

Figure 20:
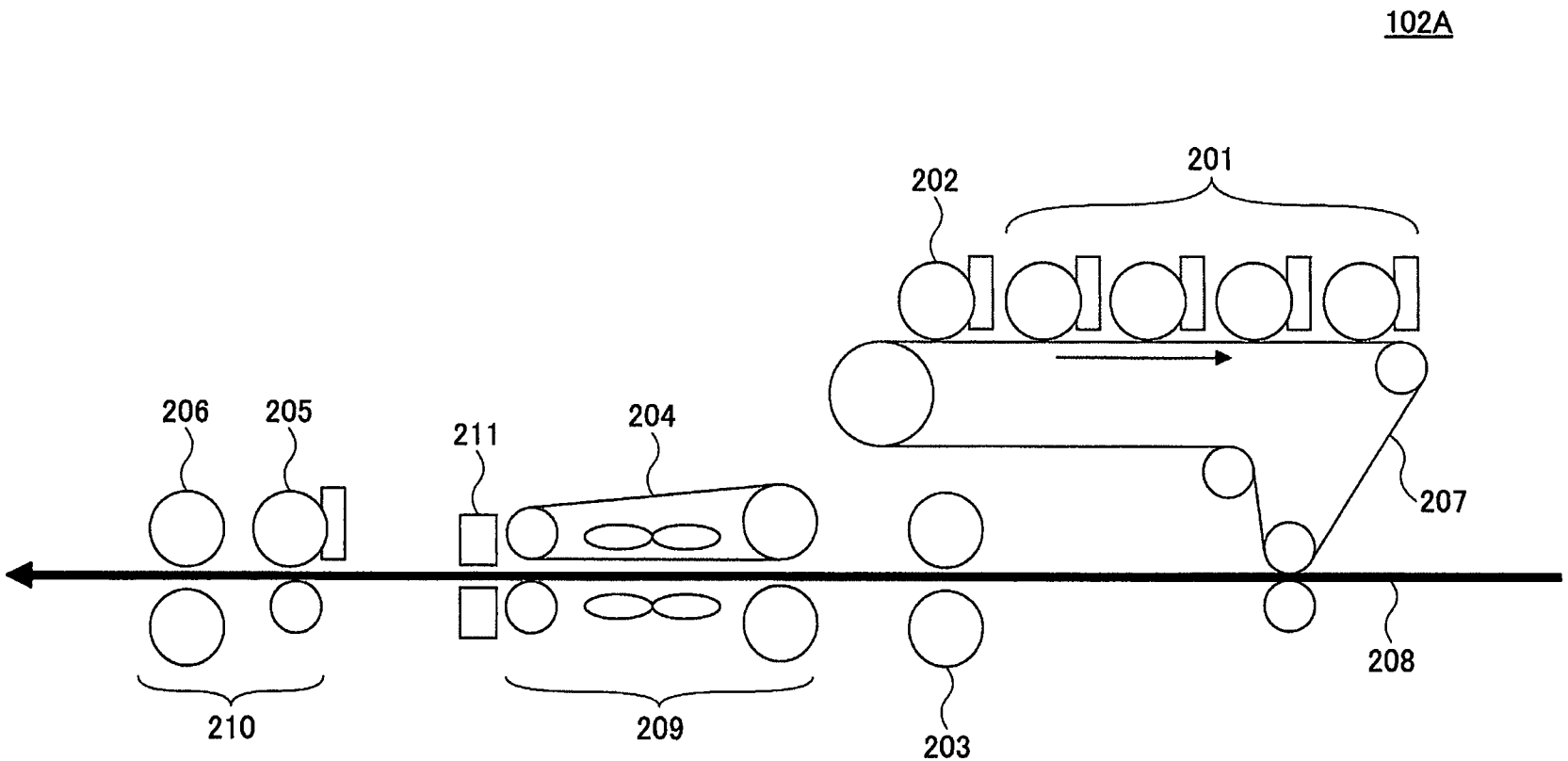
FIG. 20 is for describing a printer engine according to a thirteenth embodiment of the present invention.

FIG. 20 illustrates a printer engine 102A according to a thirteenth embodiment of the present invention. The basic configuration of this image forming apparatus is the same as that shown in FIG. 2, and therefore elements corresponding to those in FIG. 2 are not further described. The difference between the printer engine 102 shown in FIG. 2 and the printer engine 102A shown in FIG. 20 is that in the printer engine 102A, a gloss meter 211 for measuring the gloss level on both sides of a sheet is provided at the exit of the gloss level increasing device 204.

A detailed description is given of the gloss level increasing device 204 according to the present embodiment.

First, a description is given of an operation of printing an image having photographic image quality.

Figure 21:
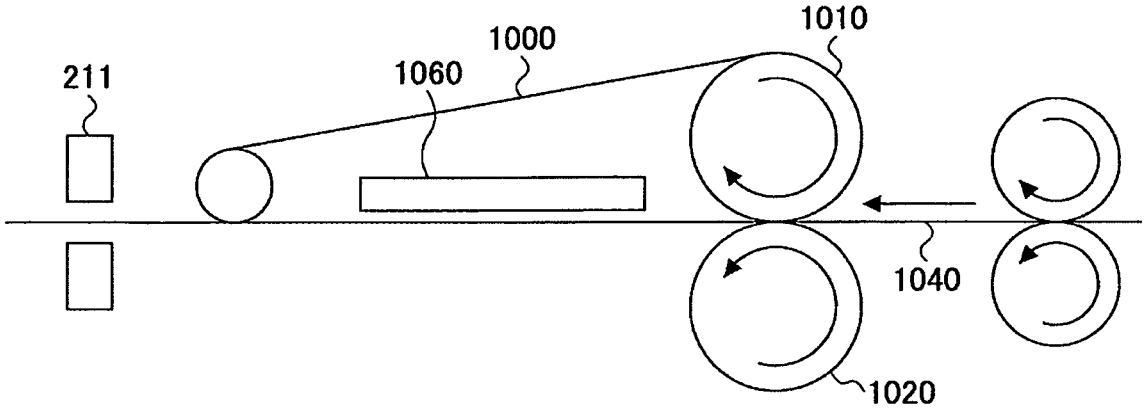
FIG. 21 is for describing a gloss level increasing device according to the thirteenth embodiment of the present invention.

When printing a photographic image, as shown in FIG. 21, the sheet 1040 that has passed through the fixing device 203 is received by the gloss level increasing device 204 in a state where the pressurizing roller 1020 used when remelting the toner is contacting the heating roller 1010 for remelting the toner. Then, the heating roller 1010 and the pressurizing roller 1020 remelt the toner on the sheet 1040. Subsequently, to turn the image surface into a mirror-like surface, the image on the sheet 1040 is caused to come in close contact with a cooling/peeling belt 1000 having a mirror surface. In this process, the sheet 1040 and the cooling/peeling belt 1000 are adhered to each other by the melted toner, and therefore the sheet does not fall down even if it is not supported from below. Furthermore, air is blown from behind the cooling/peeling belt 1000 to cool the toner while the sheet 1040 is being conveyed by the cooling/peeling belt 1000, so that the toner on the image surface is fixed (solidified). A photographic image can be created in the above manner.

In order to print photographic images on both sides of the sheet 1040, the gloss level increasing device 204 needs to remelt the toner on the back side for the purpose of making the image on the back side have photographic image quality. However, during this process, the toner of the photographic image that has already been formed on the front side of the sheet 1040 is also needlessly melted. Consequently, the gloss level of the photographic image on the front side is reduced. As a result, the photographic image on the front side and the photographic image on the back side have different gloss levels. If the gloss levels and the difference in gloss level do not change according to the environment or by degradation of the cooling/peeling belt 1000 in the gloss level increasing device 204, the difference in gloss level between the front side and the back side can be eliminated by adjusting the heating roller 1010. However, in practical situations, the gloss level changes due to the environment or by degradation of the cooling/peeling belt 1000 in the gloss level increasing device 204. Furthermore, an image forming apparatus that performs high-value-added printing operations frequently prints a large number of pages. Therefore, in the conventional technology, the gloss level may change between the beginning of the printing operation and the end of the printing operation. Accordingly, it has been difficult to stabilize the image quality.

Therefore, in the present embodiment, the gloss meter 211 for measuring the gloss level on both sides of a sheet is provided at the exit of the gloss level increasing device 204. Hence, the difference in gloss level between the two sides of a sheet can be detected during the printing operation. Thus, when the difference in gloss level gradually changes during the printing operation, such a difference can be eliminated by adjusting the temperature of the heating roller 1010. Accordingly, it is possible to constantly stabilize the quality of photographic images from the beginning to the end of the printing operation.

The gloss level is measured with a device conforming to conditions described in Japanese Industrial Standard (JIS) Z8741.

The measurement angle is preferably $\theta=20$, because photographic images have a high gloss level.

The gloss meter 211 is provided such that the gloss levels on both sides of the sheet can be measured.

When a difference arises in the gloss level between the front and back sides of a sheet, the temperature of the heating roller 1010 may be adjusted such that the gloss level is reduced. When one-sided printing is performed, the temperature of the heating roller 1010 is high enough to remelt the toner. Therefore, it would be difficult to increase the gloss level even further. For this reason, when a difference arises in the gloss level between the front and back sides of a sheet, it means that the gloss level on the front side has decreased. Therefore, in order to reduce the gloss level on the back side so as to match that of the front side, the temperature of the heating roller 1010 is decreased or the cooling ability is reduced, so that a mirror-like surface cannot be attained on the back side.

As to the difference in gloss level between both sides of a sheet, a predetermined threshold may be set in advance, so that a control operation is performed when the difference in gloss level exceeds the threshold.

Fourteenth Embodiment

A description is given of a fourteenth embodiment of the present invention. The basic configuration of the image forming apparatus is the same as that of the thirteenth embodiment, and is thus not further described.

In the thirteenth embodiment, the temperature of the heating roller 1010 is adjusted for the purpose of eliminating the difference in gloss level between the front side and the back side. The present embodiment uses a different method for changing the gloss level, with the use of the gloss level increasing device 204.

In the gloss level increasing device 204, the toner that has been solidified is remelted by the heating roller 1010. Then, the image including the remelted toner is pushed against the cooling/peeling belt 1000 having a mirror-like surface to be cooled down. Accordingly, the toner is made to have a mirror-like surface like the cooling/peeling belt 1000, so that a photographic image is formed. If the image is not sufficiently cooled down with the cooling/peeling belt 1000, the toner is peeled off before being turned into having a mirror-like surface like the cooling/peeling belt 1000. In this case, the image will not have a sufficient gloss level. Thus, when it is found that a difference in the gloss level has arisen between the front side and the back side with the gloss meter 211, the difference in gloss level can be eliminated by adjusting the cooling ability of a cooling fan 1060 for cooling the cooling/peeling belt 1000.

Unlike the method of adjusting the temperature of the heating roller 1010, with this control method, it is possible to control the gloss level on the back side without affecting the image on the front side.

Fifteenth Embodiment

A description is given of a fifteenth embodiment of the present invention. The basic configuration of the image forming apparatus is the same as that of the thirteenth embodiment, and is thus not further described. Examples of printed matter using photographic images are catalogs and direct mail. Generally, large volume printing is performed for such printed matter. Therefore, printing operations need to be performed without reducing the printing productivity. In the thirteenth and fourteenth embodiments, when large volume printing is performed, the gloss level needs to be measured every time an image is printed and the printing operation extends over a long period of time. Therefore, the gloss meter needs to be corrected. In order to correct the gloss meter, the printing process needs to be interrupted, which decreases the printing productivity.

Figure 22:
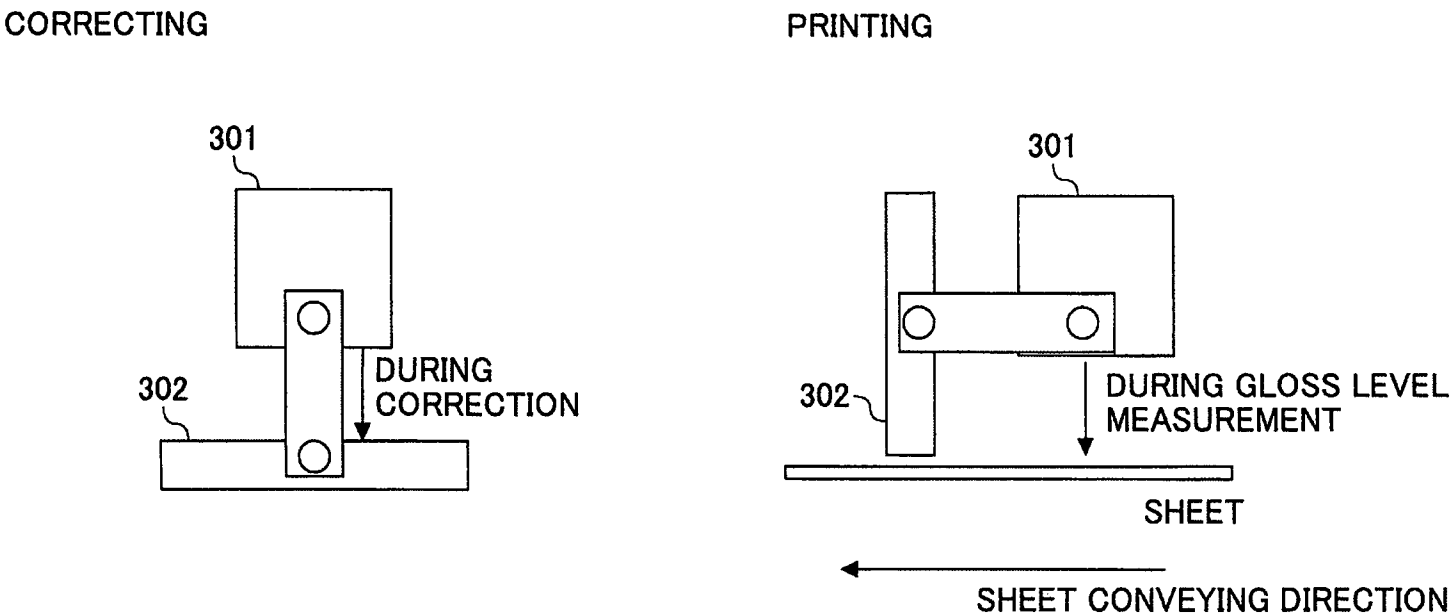
FIG. 22 illustrates enlarged views of a gloss meter and a correction plate according to an embodiment of the present invention.

Thus, in the present embodiment, a correction plate 302 is provided at a gloss meter 301 as shown in FIG. 22, so that the gloss meter 301 can be corrected at intervals between sheets, even while the printing operation is in progress. Accordingly, the printing productivity is prevented from being reduced. During the process of making the correction, the correction plate 302 is positioned along a path where the sheet passes. During a printing process, the correction plate 302 is withdrawn to a particular position so as not to obstruct sheets from being conveyed.

Sixteenth Embodiment

A description is given of a sixteenth embodiment of the present invention. The basic configuration of the image forming apparatus is the same as that of the thirteenth embodiment, and is thus not further described.

The second contact-separation mechanism 210 may be used to decrease the gloss level of an optional part (low-gloss part) of an image having photographic gloss created by the gloss level increasing device 204. In this case, even in the low-gloss part, first, a clear toner is formed by the clear toner image forming device 202, and then a photographic image is formed by the gloss level increasing device 204. Subsequently, the gloss level of the low-gloss part is decreased by the second contact-separation mechanism 210.

If the image passes through the gloss level increasing device 204 without forming a first clear toner image at the low-gloss part, it cannot be anticipated as to how the gloss level of the low-gloss part without any clear toner may change. Thus, if a printing operation is performed by the second clear toner image forming device 205 in this state, it cannot be anticipated as to whether the target gloss level can be achieved. To overcome this problem, one approach is to form an image with photographic image quality across the entire image. However, with this method, the first clear toner is used in a part where the clear toner is not necessary, and therefore the printing cost is needlessly increased.

Accordingly, in the present embodiment, the gloss meter 211 that can measure the gloss level of the entire image is provided at the exit of the gloss level increasing device 204, so that the gloss level of the low-gloss part can be measured in advance. Based on the measurement result, the fixing temperature of the second clear toner image forming device 205 is adjusted so that the low-gloss part has a requested gloss level. In this manner, the low-gloss part can be stably created without using the first clear toner.

The gloss level of the entire image can be measured by arranging plural gloss meters 211 along a line.

Seventeenth Embodiment

A description is given of a seventeenth embodiment of the present invention. The basic configuration of the image forming apparatus is the same as that of the sixteenth embodiment, and is thus not further described. In the sixteenth embodiment, the fixing temperature of the second clear toner image forming device 205 is adjusted; however, in the present embodiment, a different method is used to change the gloss level.

In a case where there are two parts where the gloss level is to be reduced (two low-gloss parts), and the target gloss level is different between these two parts, it may be difficult to form these two low-gloss parts simply by changing the fixing temperature as in the sixteenth embodiment.

In the present embodiment, based on the gloss level data obtained by the gloss meter 211, the adhering amount of second clear toner used in the second clear toner image forming device 205 is adjusted to appropriate amounts for the two low-gloss parts. Among plural low-gloss parts, the adhering amount of clear toner is increased at parts where the gloss level is to be relatively high, and the adhering amount of clear toner is reduced at parts where the gloss level is to be relatively low. In this manner, various images can be created so as to correspond to plural low-gloss parts.

Eighteenth Embodiment

A description is given of an eighteenth embodiment of the present invention. The basic configuration of the image forming apparatus is the same as that of the sixteenth embodiment, and is thus not further described.

Examples of printed matter using photographic images are catalogs and direct mail. Generally, large volume printing is performed for such printed matter. Therefore, printing operations need to be performed without reducing the printing productivity. In the sixteenth and seventeenth embodiments, when large volume printing is performed, the gloss level needs to be measured every time an image is printed, and the gloss level needs to be corrected because the printing operation extends over a long period of time. In order to correct the gloss level, the printing process needs to be interrupted, which reduces the printing productivity.

Thus, in the present embodiment, the correction plate 302 (gloss meter 301) is provided as shown in FIG. 22, so that the difference in gloss levels between the sheets can be corrected even while the printing operation is in progress. Accordingly, the printing productivity is prevented from being reduced.

According to an aspect of the present invention, the particle size of the second clear toner is larger than that of the first clear toner, and therefore images that can be felt when touched can be effectively formed. Furthermore, these images can be formed without reducing the printing productivity.

According to an aspect of the present invention, the adhering amount of the second clear toner can be optionally changed, so that an image that can be felt when touched can be formed to have an optional height. Furthermore, by reducing the adhering amount of the second clear toner, it is possible to form an image that cannot be felt when touched, in which the gloss level is reduced. Accordingly, photographic images and low gloss level images can be formed in the same image without reducing the printing productivity.

According to an aspect of the present invention, the second clear toner includes foaming toner, and therefore Braille printing can be performed, which is difficult to perform with regular toner. Accordingly, images that can be felt when touched can be effectively formed. Furthermore, these images can be formed without reducing the printing productivity.

According to an aspect of the present invention, the adhering amount of heat foaming clear toner can be optionally changed, so that an image that can be felt when touched can be formed to have an optional height. Furthermore, by reducing the adhering amount of the heat foaming clear toner, it is possible to form an image that cannot be felt when touched, in which the gloss level is reduced. Accordingly, photographic images and low gloss level images can be formed in the same image without reducing the printing productivity.

According to an aspect of the present invention, the fixing temperature of the heat foaming clear toner can be optionally changed, so that an image that can be felt when touched can be formed to have an optional height.

According to an aspect of the present invention, a determining unit that determines a first area on the recording medium where a photographic image is to be printed and a second area on the recording medium where a low gloss level image or a three-dimensional image is to be printed. Therefore, it is possible to send, to the second clear toner image forming unit, only the information relevant to the low gloss level image or the three-dimensional image.

According to an aspect of the present invention, photographic images and regular images can be alternately printed one sheet at a time. When photographic images are printed, a cooling/peeling belt of the gloss level increasing device is used. When photographic images are not printed, a pressurizing roller in the gloss level increasing device used for remelting the toner is lowered, the sheet drops down onto a sheet conveying belt by gravity, and the sheet is conveyed by the conveying belt to the second clear toner image forming device without contacting the cooling/peeling belt. Therefore, a printing operation including photographic images and images other than photographic images can be performed without reducing the printing productivity.

According to an aspect of the present invention, when images other than photographic images are printed, the sheet can be sufficiently cooled down so that the toner is completely solidified by the time the image reaches the second clear toner image forming device. Therefore, printing can be stably performed at the second clear toner image forming device.

According to an aspect of the present invention, the sheet can be stably transferred onto the sheet conveying belt, regardless of the stiffness of the sheet.

According to an aspect of the present invention, it is possible to detect changes in the stiffness of the sheet caused by the environment during the printing operation. Therefore, the sheet can be stably transferred onto the sheet conveying belt.

According to an aspect of the present invention, the moisture content of the sheet can be measured before the sheet enters the gloss level increasing device. Therefore, the sheet can be stably transferred onto the sheet conveying belt.

According to an aspect of the present invention, the sheet resistance can be measured before the sheet enters the gloss level increasing device. Therefore, the sheet can be stably transferred onto the sheet conveying belt.

According to an aspect of the present invention, the gloss level increasing device uniformly increases the gloss level across the entire image, the second clear toner image forming device adheres second clear toner to parts where the gloss level is to be reduced, and the second fixing device fixes the second clear toner so that the gloss level is reduced. Therefore, the gloss level can be reduced at optional areas of the image. By adjusting the area ratios of these optional areas, the gloss level can vary continuously between a low gloss level and a high gloss level. Furthermore, a gloss meter for simultaneously measuring the gloss levels of both sides of a sheet is provided at the exit of the gloss level increasing device. Therefore, the gloss levels can be measured when photographic images are printed by double-sided printing. Thus, it is possible to detect a difference in the gloss level between the images on both sides, which is caused by changes in the environment or degradation of components of the gloss level increasing device. In order to eliminate this difference, the temperature of the roller in the gloss level increasing device used for remelting the toner can be adjusted. Accordingly, it is possible to constantly stably form photographic images in which there are no differences in the gloss level between both sides of the sheet.

In a conventional image forming apparatus that performs high-added value printing, large volume printing is performed. Therefore, it is important that the printing operation is stably performed, and that the gloss level of the images does not change during the printing operation. Furthermore, when both sides of the sheet are made to have a photographic gloss level at the cooling/peeling device, the gloss level of the side on which an image is first turned into a photographic image may decrease when the image on the other side is turned into a photographic image. Thus, the gloss level on the front side and the gloss level on the back side may become different.

The gloss level of the image may vary according to the gloss level of the sheet, and therefore in the conventional technology, the printing conditions are adjusted according to the gloss level of the sheet. However, the gloss level of the image may change according to changes in the toner, which are caused by changes in the components of the image forming apparatus or in the environment. Therefore, the gloss level of the image may not be controlled based on only the gloss level of the sheet.

Accordingly, there has been demand for an image forming apparatus, with which a wide range of gloss levels ranging from a low gloss level to a high gloss level can be reproduced, differences in gloss levels between photographic images on both sides of a sheet are eliminated, and an optional gloss level specified within the gloss level range can be stably reproduced, even when large volume printing is performed.

According to an aspect of the present invention, it is possible to detect when a difference in the gloss level arises between the images on both sides of a sheet, which is caused by changes in the environment or time degradation of components of the gloss level increasing device. By adjusting the cooling temperature for cooling toner in the gloss level increasing device, it is possible to eliminate the difference in the gloss level between the images on both sides of a sheet, and to constantly stably form photographic images in which there are no differences in the gloss level between both sides of the sheet.

According to an aspect of the present invention, during a large volume printing operation, a correction plate that is attached to the gloss level increasing device corrects the gloss meter while the printing operation is in progress. Therefore, printing can be stably performed without reducing the printing productivity.

According to an aspect of the present invention, the gloss level increasing device forms a photographic image, the second clear toner image forming device adheres second clear toner to parts where the gloss level is to be reduced, and the second fixing device fixes the second clear toner so that the gloss level is reduced. Therefore, the gloss level can be reduced at optional areas of the image. Furthermore, a gloss meter provided in the gloss level increasing device can measure the gloss level of the entire surface of the image. Therefore, it is possible to know the gloss levels of the low gloss level parts before printing with the second clear toner image forming device. Based on the measured gloss levels, the fixing temperature of the second clear toner image forming device is adjusted, so that a requested gloss level can be attained at the low gloss level parts. Furthermore, there is no need to apply first clear toner to the low gloss level parts, and therefore the printing cost can be reduced.

The present invention is not limited to the specific embodiments described herein, and variations and modifications may be made without departing from the scope of the present invention.

The present application is based on Japanese Priority Patent Application No. 2010-039972, filed on Feb. 25, 2010, Japanese Priority Patent Application No. 2010-044756, filed on Mar. 1, 2010, and Japanese Priority-Patent Application No. 2010-227807, filed on Oct. 7, 2010, the entire contents of which are hereby incorporated herein by reference.

What is claimed is:

1. An image forming apparatus comprising:

a color toner image forming unit that forms a color toner image on a recording medium, with the use of at least one of plural color toners of different colors;

a first colorless transparent toner image forming unit that forms a first colorless transparent toner image on the color toner image, with the use of a first colorless transparent toner;

a first fixing unit that fixes the color toner image and the first colorless transparent toner image on the recording medium, so that an image formed by using the at least one of plural color toners and the first colorless transparent toner is fixed on the recording medium;

a gloss level increasing device that increases a gloss level of the entirety of the image formed by using the at least one of plural color toners and the first colorless transparent toner on the recording medium that has been fixed by the first fixing unit;

a second colorless transparent toner image forming unit that forms a second colorless transparent toner image on the image whose gloss level has been increased by the gloss level increasing device, with the use of a second colorless transparent toner; and a second fixing unit that fixes the second colorless transparent toner image on the recording medium.

2. The image forming apparatus according to claim 1, further comprising:

a first switching unit that switches between a process in which the gloss level increasing device increases the gloss level, and a process in which the gloss level increasing device does not increase the gloss level; and a second switching unit that switches between a process in which the second colorless transparent toner image forming unit forms the second colorless transparent toner image and the second fixing device fixes the second colorless transparent toner image, and a process in which the second colorless transparent toner image forming unit does not form the second colorless transparent toner image and the second fixing device does not fix the second colorless transparent toner image.

3. The image forming apparatus according to claim 1, further comprising:

a gloss information attaching unit that attaches gloss information items to pixel information items representing pixels included in image information of the color toner image to be formed on the recording medium with the use the at least one of plural color toners;

a gloss production method determining unit that determines a gloss production method for the respective pixels represented by the pixel information items, based on the corresponding gloss information items;

a control unit that performs a control operation to implement the gloss production method determined by the gloss production method determining unit, wherein the gloss production method determining unit determines the gloss production method from among plural types of the gloss production method including a gloss production method A in which the first colorless transparent toner image forming unit forms the first colorless transparent toner image on the color toner image that has been formed on the recording medium by the color toner image forming unit, the first fixing unit fixes the image including the at least one of plural color toners and the first colorless transparent toner on the recording medium, and the gloss level increasing device increases the gloss level of the entirety of the image including the at least one of plural color toners and the first colorless transparent toner on the recording medium that has been fixed by the first fixing unit, a gloss production method B in which the first colorless transparent toner image forming unit forms the first colorless transparent toner image on the color toner image that has been formed on the recording medium by the color toner image forming unit, and the first fixing unit fixes the image including the at least one of plural color toners and the first colorless transparent toner on the recording medium, a gloss production method C in which the first colorless transparent toner image forming unit forms, on the color toner image that has been formed on the recording medium by the color toner image forming unit, another type of the first colorless transparent toner image that is a different type from the first colorless transparent toner image formed in the gloss production method B, and the first fixing unit fixes the image including the at least one of plural color toners and the other type of the first colorless transparent toner on the recording medium, and a gloss production method D in which the first fixing unit fixes the color toner image on the recording medium that has been formed by the color toner image forming unit, the second colorless transparent toner image forming unit forms the second colorless transparent toner image on the color toner image, and the second fixing unit fixes the second colorless transparent toner image on the recording medium.

4. The image forming apparatus according to claim 3, wherein if the gloss production method determining unit does not determine the gloss production method, the control unit performs the control operation so that none of the plural types of the gloss production methods are implemented, and only the color toner image forming unit forms the color toner image on the recording medium and the first fixing unit fixes the color toner image on the recording medium.

5. The image forming apparatus according to claim 3, wherein in the gloss production method A and the gloss production method B, the first colorless transparent toner image forming unit forms the first colorless transparent toner image such that a total thickness of a thickness of the color toner image and a thickness of the first colorless transparent toner image is a predetermined value.

6. The image forming apparatus according to claim 3, wherein in the gloss production method C, the first colorless transparent toner image forming unit forms the other type of the first colorless transparent toner image including halftone dots having a predetermined wavelength and a predetermined amplitude.

7. The image forming apparatus according to claim 3, wherein in the gloss production method D, the second colorless transparent toner image forming unit forms the second colorless transparent toner image having a predetermined thickness.

8. The image forming apparatus according to claim 3, wherein when the image information of the color toner image corresponding to one page to be formed on the recording medium includes the pixel information item having the gloss information item expressing a higher gloss level than a gloss level that can be produced by the gloss production method B, the gloss production method determining unit determines the gloss production method A and the gloss production method D as the gloss production methods used for forming the color toner image corresponding to the one page.

9. The image forming apparatus according to claim 3, wherein when the image information of the color toner image corresponding to one page to be formed on the recording medium does not include the pixel information item having the gloss information item expressing a higher gloss level than a gloss level that can be produced by the gloss production method B, but includes the pixel information item having the gloss information item expressing a lower gloss level than a gloss level that can be produced by the gloss production method C, the gloss production method determining unit determines the gloss production method B, the gloss production method C, and the gloss production method D as the gloss production methods used for forming the color toner image corresponding to the one page.

10. The image forming apparatus according to claim 3, wherein when the image information of the color toner image corresponding to one page on the recording medium does not include the pixel information item having the gloss information item expressing a higher gloss level than a gloss level that can be produced by the gloss production method B, and does not include the pixel information item having the gloss information item expressing a lower gloss level than a gloss level that can be produced by the gloss production method C, the gloss production method determining unit determines the gloss production method B and the gloss production method C as the gloss production methods used for forming the color toner image corresponding to the one page.

11. The image forming apparatus according to claim 3, wherein the gloss information attaching unit attaches the gloss information items to the pixel information items representing the pixels included in the image information of the image to be formed on the recording medium with the use the at least one of plural color toners and the first colorless transparent toner, and the gloss production method determining unit determines the gloss production method for the respective pixels, based on the corresponding gloss information items and the image information including the corresponding pixel information items relevant to the first colorless transparent toner.

12. The image forming apparatus according to claim 11, wherein if the gloss production method determining unit does not determine the gloss production method, the control unit performs the control operation so that none of the plural types of the gloss production methods are implemented, and only the color toner image forming unit forms the color toner image on the recording medium, the first colorless transparent toner image forming unit forms the first colorless transparent toner image on the color toner image, and the first fixing unit fixes the color toner image and the first colorless transparent toner image on the recording medium.

13. The image forming apparatus according to claim 12, wherein when the image information of the color toner image corresponding to one page to be formed on the recording medium includes the pixel information item having the gloss information item expressing a higher gloss level than a gloss level that can be produced by the gloss production method B, the control unit performs the control operation such that the first fixing unit fixes the color toner image formed on the recording medium by the color toner image forming unit, the gloss level increasing device increases the gloss level of the entire color toner image, the second colorless transparent toner image forming unit forms the second colorless transparent toner image on the color toner image on the recording medium, and the second fixing unit fixes the second colorless transparent toner image on the recording medium.

14. The image forming apparatus according to claim 1, wherein a particle size of the second colorless transparent toner is larger than that of the first colorless transparent toner.

15. The image forming apparatus according to claim 1, further comprising:

a determining unit that determines a first area on the recording medium where a photographic image is to be printed and a second area on the recording medium where a low gloss level image or a three-dimensional image is to be printed; and a sending unit that sends, to the second colorless transparent toner image forming unit, information relevant to the second area where the low gloss level image or the three-dimensional image is to be printed.

16. The image forming apparatus according to claim 1, further comprising:

a contact-separation mechanism that causes rollers to contact and separate from one another, the rollers being used to remelt toner in the gloss level increasing device; and a conveying belt that conveys the recording medium in such a manner that the gloss level is not increased by the gloss level increasing device, when a photographic image is not to be formed on the recording medium.

17. The image forming apparatus according to claim 16, wherein the gloss level increasing device includes a cooling/peeling device that implements a cooling and peeling principle, wherein the cooling/peeling device includes a cooling mechanism that cools down the conveying belt that conveys the recording medium when the photographic image is not to be formed.

18. The image forming apparatus according to claim 16, further comprising:

a stabilizing mechanism that stabilizes a conveying path of the recording medium in accordance with a temperature and humidity detected with a temperature and humidity sensor and also in accordance with a specified thickness of the recording medium, when the photographic image is not to be printed.

19. The image forming apparatus according to claim 16, further comprising:

a stabilizing mechanism that stabilizes a conveying path of the recording medium in accordance with a moisture content of the recording medium measured with a moisture content meter before the recording medium enters the gloss level increasing device, and also in accordance with a specified thickness of the recording medium, when the photographic image is not to be printed.

20. The image forming apparatus according to claim 1, further comprising:

a gloss level measuring unit that simultaneously measures the gloss levels on both sides of the recording medium, the gloss level measuring unit being provided at an exit of the gloss level increasing device; and a temperature control unit that controls a temperature at which toner is remelted by the gloss level increasing device, based on information obtained by the gloss level measuring unit.

* * * * *

UNITED STATES PATENT AND TRADEMARK OFFICE

CERTIFICATE OF CORRECTION

PATENT NO. : 8,494,385 B2
APPLICATION NO. : 12/929556
DATED : July 23, 2013
INVENTOR(S) : Masakazu Terao et al.

It is certified that error appears in the above-identified patent and that said Letters Patent is hereby corrected as shown below:

On the title page item (75), should read: Masakazu Terao, Kanagawa (JP)
Kentarou Matsumoto, Tokyo (JP)
Shinya Kobayashi, Kanagawa (JP)
Akio Tsujita, Kanagawa (JP)
Masato Iio, Kanagawa (JP)
Katsuhiro Shinohara, Kanagawa (JP)
Tadashi Kasai, Kanagawa (JP)

Signed and Sealed this
Sixth Day of May, 2014

Michelle K. Lee

Michelle K. Lee
*Deputy Director of the United States Patent and Trademark Office*